US012048324B2

(12) United States Patent
Dishion et al.

(10) Patent No.: US 12,048,324 B2
(45) Date of Patent: Jul. 30, 2024

(54) SYSTEMS AND METHODS FOR A CLOSING MACHINE

(71) Applicant: Coastal Counting & Industrial Scale Company, Inc., Santa Paula, CA (US)

(72) Inventors: John Dishion, Santa Paula, CA (US); Jason Satnick, Santa Paula, CA (US)

(73) Assignee: Coastal Counting & Industrial Scale Company, Inc., Santa Paula, CA (US)

( * ) Notice: Subject to any disclaimer, the term of this patent is extended or adjusted under 35 U.S.C. 154(b) by 0 days.

(21) Appl. No.: 18/509,204

(22) Filed: Nov. 14, 2023

(65) Prior Publication Data

US 2024/0156149 A1 May 16, 2024

Related U.S. Application Data

(60) Provisional application No. 63/425,245, filed on Nov. 14, 2022.

(51) Int. Cl.

| | |
|---|---|
| ***A24C 5/54*** | (2006.01) |
| ***A24C 5/06*** | (2006.01) |
| ***A24C 5/12*** | (2006.01) |
| ***A24C 5/32*** | (2006.01) |
| ***A24C 5/39*** | (2006.01) |

(52) U.S. Cl.

CPC ..... *A24C 5/54* (2013.01); *A24C 5/06* (2013.01); *A24C 5/12* (2013.01); *A24C 5/322* (2013.01); *A24C 5/396* (2013.01)

(58) Field of Classification Search

None

See application file for complete search history.

(56) References Cited

U.S. PATENT DOCUMENTS

| | | | | |
|---|---|---|---|---|
| 2019/0320710 | A1 | 10/2019 | Sirois et al. | |
| 2020/0288768 | A1* | 9/2020 | Crowe | A24C 5/54 |
| 2021/0022388 | A1* | 1/2021 | Sullivan | A24C 5/02 |
| 2021/0267264 | A1 | 9/2021 | Grigsby | |
| 2021/0392944 | A1* | 12/2021 | Kustal | A24C 5/54 |
| 2022/0110359 | A1 | 4/2022 | Giddings et al. | |
| 2022/0160021 | A1* | 5/2022 | Manalang | A24C 5/54 |

OTHER PUBLICATIONS

"International Search Report and Written Opinion of the International Searching Authority," issued in connection with Int'l Appl. No. PCT/US2023/079700, dated Mar. 19, 2024 (9 pages).

* cited by examiner

*Primary Examiner* — Katherine A Will

(74) *Attorney, Agent, or Firm* — Holland & Hart LLP

(57) ABSTRACT

A closing machine including a cone loading/unloading station, at least one pick and place gripper, a holder assembly, a closing station, and a collection station. The cone loading/unloading station is configured to receive a lower tube assembly and a tray including a plurality of cones. The at least one pick and place gripper is configured to grab at least one cone of the plurality of cones. The holder assembly is configured to receive the at least one cone and move the at least one cone through the closing machine. The closing station is configured to receive the at least one cone from the holder assembly and configured to close an end of the at least one cone. The holder assembly is further configured to release the at least one cone into the collection station.

19 Claims, 22 Drawing Sheets

SYSTEMS AND METHODS FOR A CLOSING MACHINE

CROSS-REFERENCE TO RELATED APPLICATION

This application claims the benefit of U.S. Provisional Patent Application No. 63/425,245, entitled "SYSTEMS AND METHODS FOR AN AUTOMATIC FILLING MACHINE," filed on Nov. 14, 2022, which is specifically incorporated by reference for all it discloses and teaches.

TECHNICAL FIELD

The present invention is in the technical field of closing systems and more particularly to a preroll closing machine for the production of prerolls that are compliant, consistent, repeatable, and scalable for automatic cone filling.

BACKGROUND

Prerolled cones filled with smokeable product are typically manually closed in a labor-intensive process. Typically, a laborer receives a plurality of prerolled cones and manually twists or folds each cone to close the cone and secure the smokeable product in the cone. This process is time consuming, and costly. If the closing process is automated, the closing system is typically integrated into a larger manufacturing system such that the closing system does not operate independently of the larger system. For example, some closing systems may be integrated into a weighing system. If a portion of the weighing system malfunctions and is shut down for repairs, the closing system would also be shut down until the larger system is repaired. Thus, integration into a larger system may prevent the closing system from operating with other equipment and may lead to unnecessary down time.

Therefore, there is a need for a closing system that overcomes the above referenced limitations by closing prerolled cones independent of a larger manufacturing system.

SUMMARY

An aspect of the present disclosure relates to a closing machine including a cone loading/unloading station, at least one pick and place gripper, a holder assembly, a closing station, a cut station, and a collection station. The cone loading/unloading station is configured to receive a lower tube assembly and a tray including a plurality of cones. The cone loading/unloading station, the lower tube assembly, and the tray defines a locking mechanism that is configured to maintain the lower tube assembly and the tray in position on the cone loading/unloading station. The at least one pick and place gripper is configured to grab at least one cone of the plurality of cones in the lower tube assembly and the tray. The holder assembly is configured to receive the at least one cone from the at least one pick and place gripper and move the at least one cone through the closing machine. The closing station is configured to receive the at least one cone from the holder assembly and configured to close an end of the at least one cone. The cut station is configured to remove excess material from the end of the at least one cone. The holder assembly is further configured to release the at least one cone into the collection station.

Another aspect of the present disclosure relates to a method of closing a plurality of prerolled cones containing a smokable product using a closing machine. The closing machine includes a cone loading/unloading station, a pick and place gripper, a holder assembly, a closing station, a cut station, a vacuum collector, a tamp station, and a collection station. The method includes grabbing at least one cone using the pick and place gripper. The method also includes depositing the at least one cone into the holder assembly using the pick and place gripper. The method further includes closing an end of each of the cones using the closing station. The method also includes cutting excess material from an end of the cones using the cut station. The method further includes tamping the cones using the tamp station. The method also includes releasing the cones in the collection station.

Yet another aspect of the present disclosure relates to a method of manufacturing a plurality of prerolled cones using a system. The system includes a measuring station, a tamping station, a closing machine, the closing machine includes a cone loading/unloading station, a pick and place gripper, a holder assembly, a closing station, a cut station, a vacuum collector, a tamp station, and a collection station. The method includes measuring a predetermined amount of smokable product using the measuring station. The method also includes filling the predetermined amount of smokable product in at least one cone using the measuring station. The at least one cone is positioned in a cavity of a lower tube assembly and a tray during filling. The method further includes transporting the lower tube assembly, the tray, and the at least one cone to the tamping station. The method also includes tamping the at least one cone using the tamping station. The method further includes receiving the lower tube assembly, the tray, and the at least one cone into the closing machine. The method also includes locking the lower tube assembly and the tray into the cone loading/unloading station using a locking mechanism. The method further includes grabbing the at least one cone using the pick and place gripper. The method also includes depositing the at least one cone into the holder assembly using the pick and place gripper. The method further includes closing an end of each of the cones using the closing station. The method also includes cutting excess material from an end of the at least one cone using the cut station. The method further includes tamping the at least one cone using the tamp station. The method also includes releasing the at least one cone in the collection station.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label.

Figure 1:
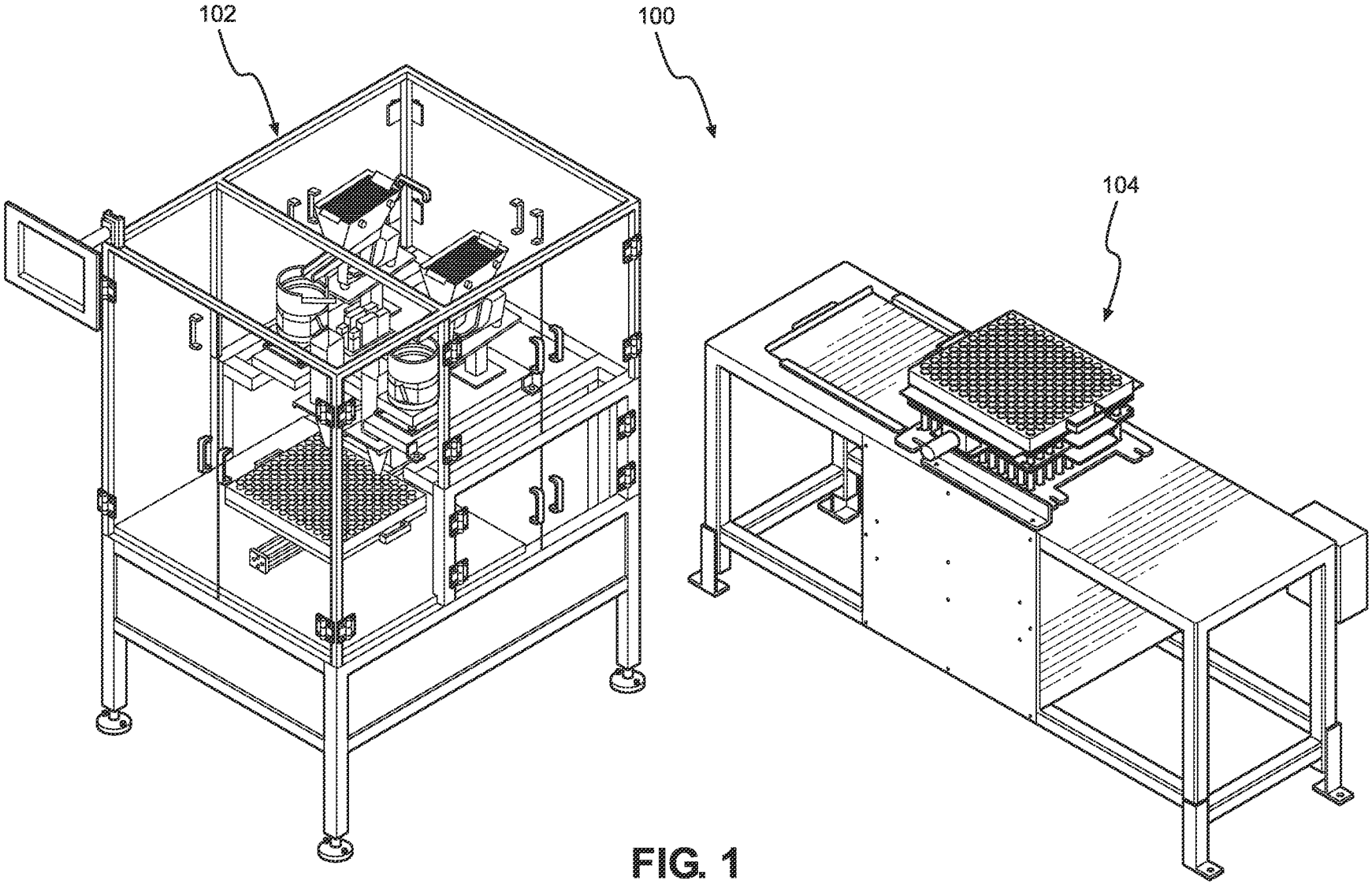
FIG. 1 illustrates a perspective view of an accurate net weight based rolling system for producing prerolls that are compliant, consistent, repeatable, and scalable for automatic cone filling in accordance with aspects of the current disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

FIG. 1 illustrates a perspective view of an accurate net weight based rolling system 100 for producing cones that are compliant, consistent, repeatable, and scalable for automatic cone filling, according to one embodiment of the present invention. The accurate net weight based rolling system 100 includes a measuring station 102 and a tamping station 104. During operation of the measuring station 102, smokable product is precisely loaded weigh bucket scoops (not shown) in a controlled and predictable manner such that each weigh bucket scoop is filled with a precise, predetermined amount of smokable product. The predetermined amount of smokable product is the target weight of the smokable product in each cone. Each cone may have a different predetermined amount of smokable product depending on the size of the cone and the characteristics of the smokable product. Weigh modules (not shown) then precisely weigh the smokable product in each weigh bucket scoop to ensure that each cone (not shown) is filled with a predetermined amount of smokable product within a predetermined tolerance. The predetermined tolerance is the acceptable range or limits of variation within the predetermined amount of smokable product (target weight). If the smokable product in the weigh bucket scoops is within a predetermined tolerance of the predetermined amount of smokable product, the weigh bucket scoops feed the smokable product into the cavities (not shown) of a puck (not shown) and the puck is moved to the tamping station 104 for packing. Each portion of the measuring station 102 is precisely designed to feed a consistent amount of smokable product through the measuring station 102 such that each cavity contains the predetermined amount of smokable product within the predetermined tolerance.

Figure 5:
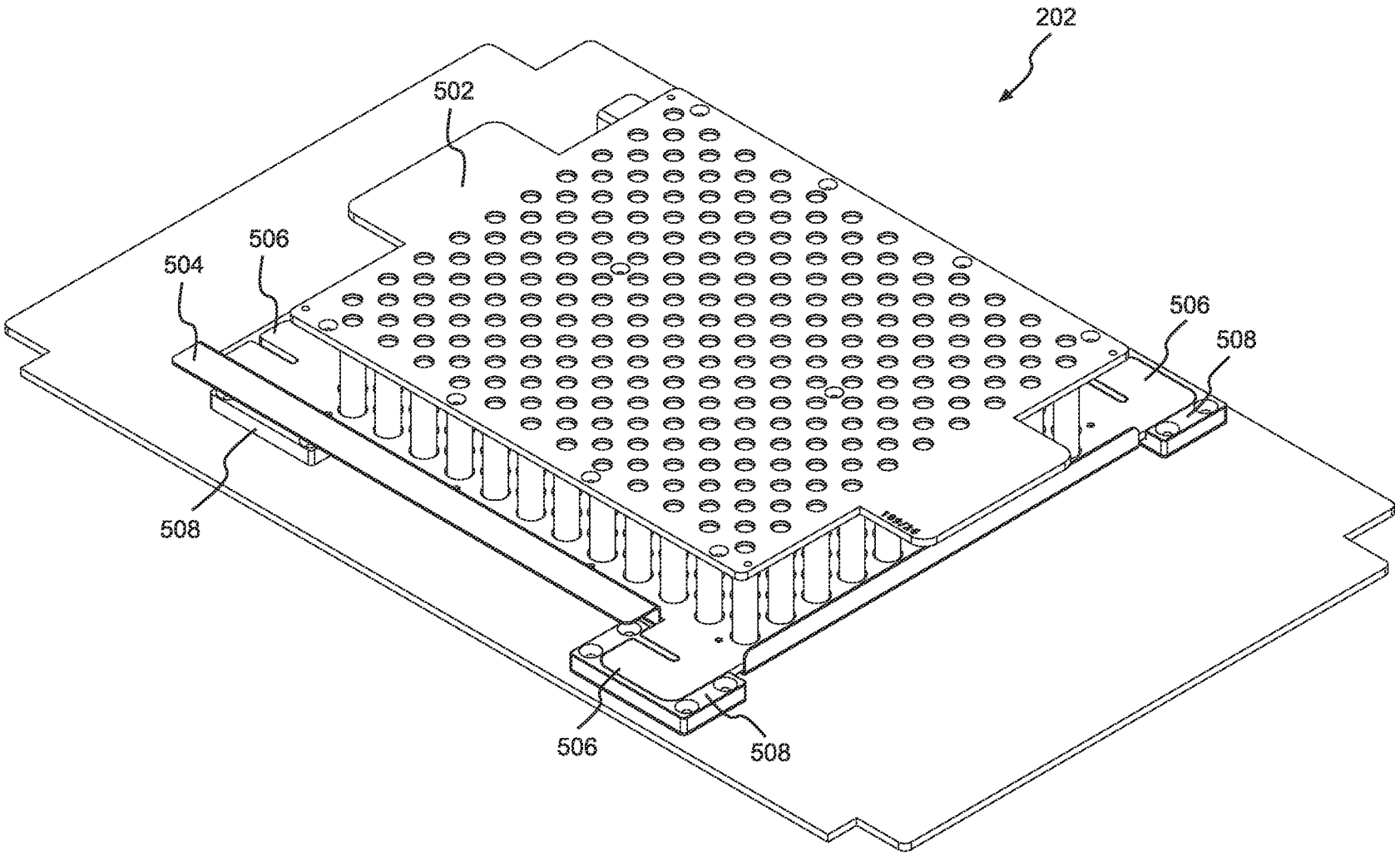
FIG. 5 illustrates a perspective view of a cone loading/unloading station shown in FIG. 2 in accordance with aspects of the current disclosure.

During operation of the tamping station 104, the cones are preassembled and placed in an upper tube assembly (not shown). The puck is filled with smokable product by the measuring station 102 as described above. The puck is stacked onto the upper tube assembly and a lower tube assembly 502 as shown in FIG. 5. The smokable product falls into the cones from the puck and the upper tube assembly, the lower tube assembly 502, and the puck are vibrated to settle the smokable product in the cones. The cones descend from the upper tube assembly to the loose, frictionless lower tube assembly 502 and are continuously vibrated. The upper tube assembly is removed to expose the filled, tamped cones. The precisely filled, tamped cones are then slid onto a receiving tray 504 with no loss of product and are slightly elevated to expose the cones for ease of access for removal and/or end twisting. The accurate net weight based rolling system 100 is described in greater detail in currently pending U.S. patent application Ser. No. 17/986,730, filed Nov. 14, 2022, and entitled "SYSTEMS AND METHODS FOR AN AUTOMATIC FILLING MACHINE," the disclosure of which is hereby incorporated by reference in its entirety.

Figure 2:
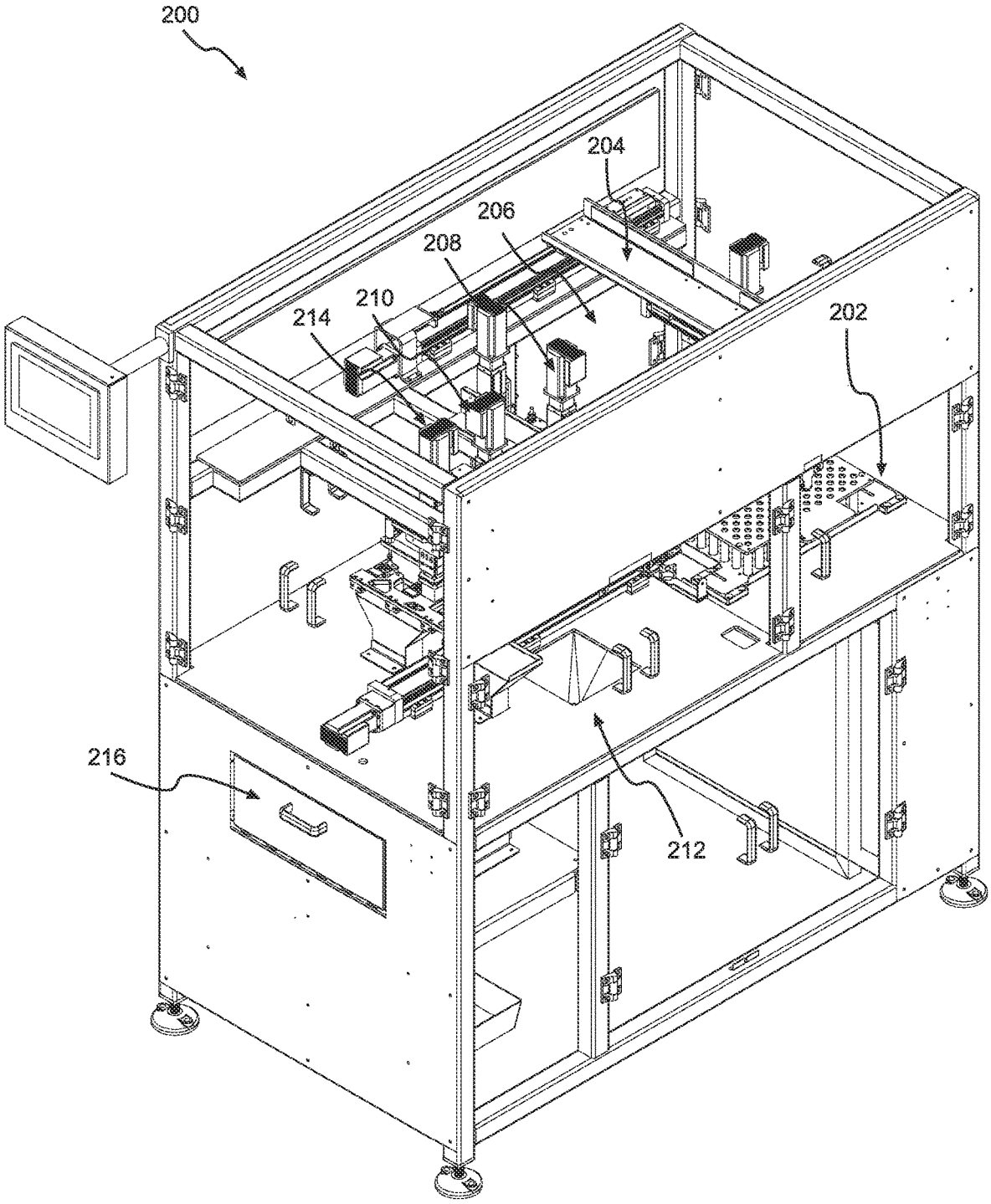
FIG. 2 illustrates a perspective view of a modular pre-roll closing machine for closing cones in a manner similar to hand twisted cones that are compliant, consistent, repeatable, and scalable in accordance with aspects of the current disclosure.
Figure 3:
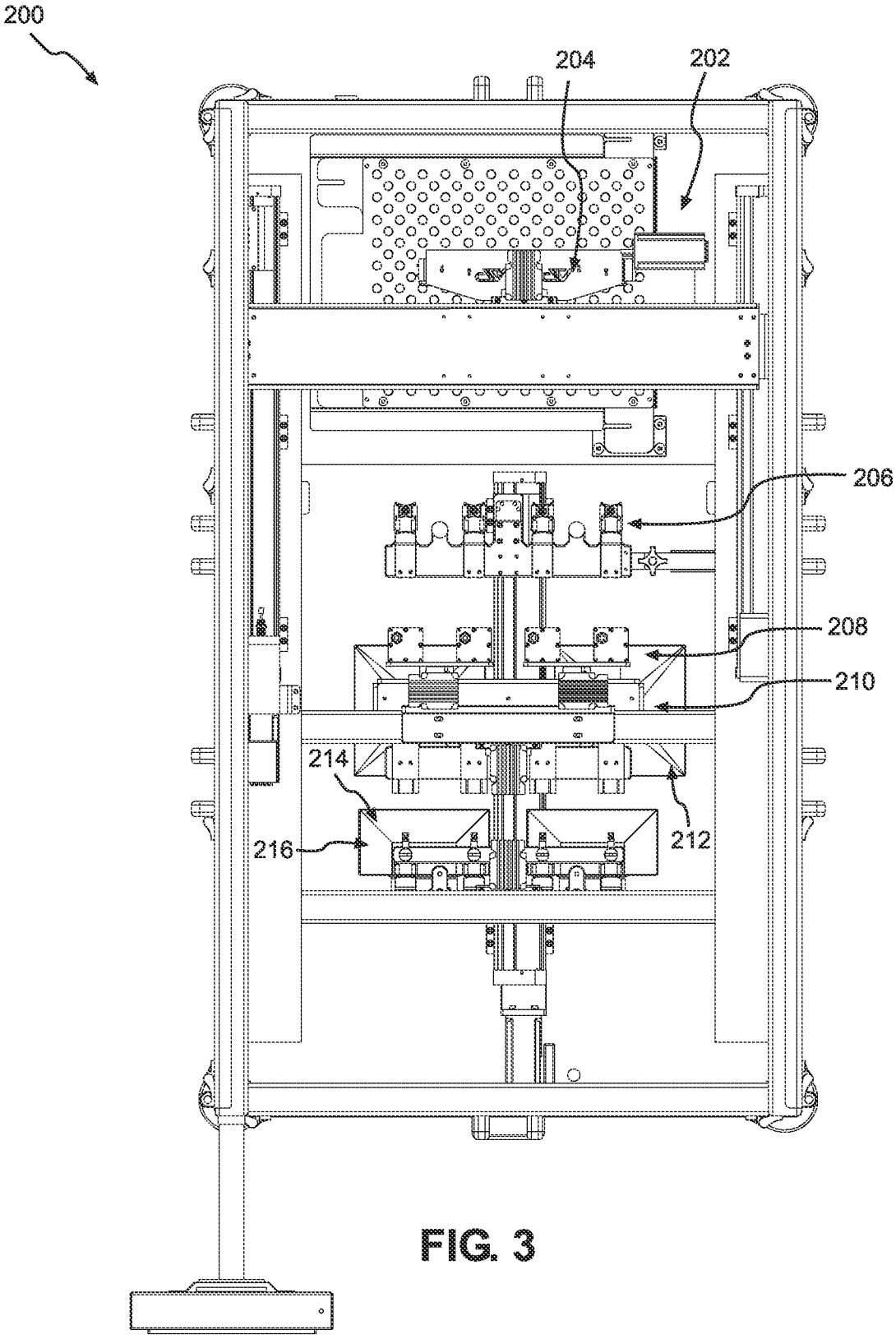
FIG. 3 illustrates a top view of the modular pre-roll closing machine shown in FIG. 2 in accordance with aspects of the current disclosure.
Figure 4:
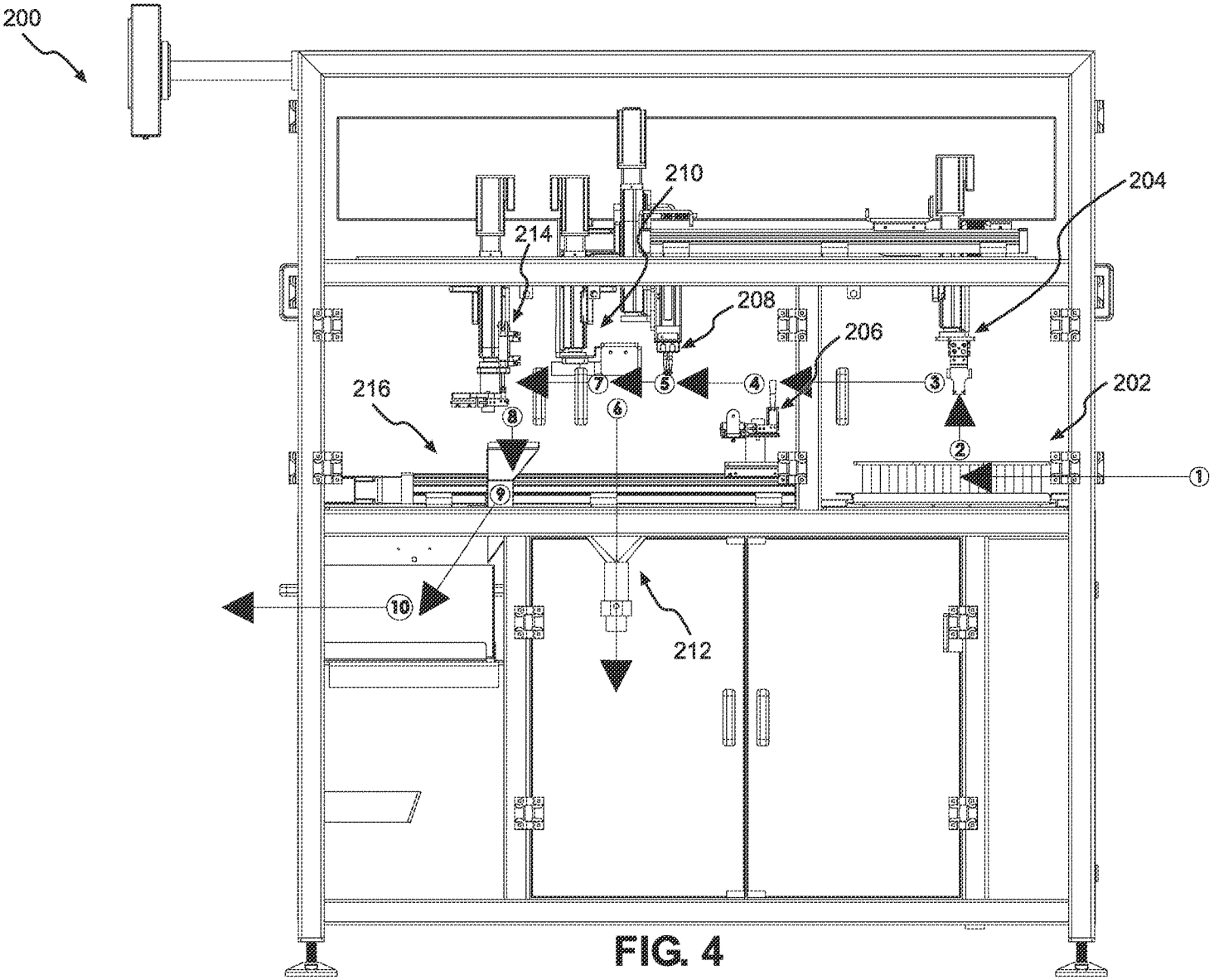
FIG. 4 illustrates a side view of the modular pre-roll closing machine shown in FIG. 2 in accordance with aspects of the current disclosure.

FIG. 2 illustrates a perspective view of a modular pre-roll closing machine 200 for closing cones in a manner similar to hand twisted cones that are compliant, consistent, repeatable, and scalable. FIG. 3 illustrates a top view of the modular pre-roll closing machine 200 shown in FIG. 2. FIG. 4 illustrates a side view of the modular pre-roll closing machine 200 shown in FIG. 2 and further included arrows that illustrate the progression of a cone through the modular pre-roll closing machine 200.

As shown in FIGS. 2-4, the closing machine 200 is separate and distinct from the measuring station 102 and the tamping station 104 of the accurate net weight based rolling system 100. Maintaining the closing machine 200 as a separate, standalone, and operationally distinct unit enables the operator to maintain operational flexibility while still enabling the closing machine 200 to be integrated into larger systems and facilities. For example, maintaining the closing machine 200 as a separate, standalone, and operationally distinct unit enables the closing machine 200 to continue operating if the measuring station 102, the tamping station 104, and/or other manufacturing units shut down for repairs. The closing machine 200 may still be able to be integrated into a larger system by automatically sending the output of the closing machine 200 to other units using integrated transport systems (see FIG. 21) and/or integrating the closing machine 200 into a system including the measuring station 104 and the tamping station 104. However, the closing machine 200, the measuring station 104, and the tamping station 104 may be separate and distinct units within the system. As such, maintaining the closing machine 200 as a separate, standalone, and operationally distinct unit enables the operator to maintain operational flexibility while still enabling the closing machine 200 to be integrated into larger systems and facilities.

As shown in FIGS. 2-4, the closing machine 200 includes a cone loading/unloading station 202, a pick and place gripper 204, a holder assembly 206, a closing station 208, a cut station 210, a vacuum collector 212, a tamp station 214, and a collection station 216. During operations, a tray of pre-rolls is weighed and filled by the accurate net weight based rolling system 100 described above and the lower tube assembly 502 and the tray 504 including the loaded cones are moved from the tamping station 104 to the cone loading/unloading station 202. The lower tube assembly 502 and the tray 504 are locked in place, and the cones are picked up out of the lower tube assembly 502 and the tray 504 by the pick and place gripper 204. The pick and place gripper 204 pick up four cones at a time and moves them to the holder assembly 206. The holder assembly 206 is custom machined to the exact conical shape of the cones. After the cones are in the holder assembly 206, the holder assembly 206 moves the cones through the closing machine 200 to the various stations. The first station is the closing station 208, where the tops of the cones are closed. The second station is the cutting station 210, where the excess paper on the tops of the cones is cut off and discarded into the vacuum collector 212. The third station is the tamp station 214, where the tops of the cones are supported with grippers and then pressed with an actuator to tamp each of the cones. The final station is the collection station 216, where the cones are released from the holder assembly 206 and dropped down a funnel into a collection bin.

FIG. 4 illustrates the progression of the cones through the closing machine 200. Step 1 includes loading the lower tube assembly 502 and the tray 504 (including the loaded cones) into the cone loading/unloading station 202. Step 2 includes picking up the cones with the pick and place gripper 204. Step 3 includes moving the cones with the pick and place gripper 204 into the holder assembly 206. Step 4 includes moving the cones with the holder assembly 206 to the closing station 208 and closing the cones with the closing station 208. Step 5 includes moving the cones with the holder assembly 206 to the cut station 210 and cutting off the excess paper on the tops of the cones with the cut station 210. Step 6 includes removing the excess paper from the tops of the cones with the vacuum collector 212. Step 7 includes moving the cones with the holder assembly 206 to the tamp station 214 and tamping the cones with the tamp station 214. Step 8 includes releasing, with the holder assembly 206, the cones into the collection station 216. Step 9 includes guiding the cones into a collection bin using a funnel. Step 10 includes removing the collection bin from the closing machine 200.

Figure 6:
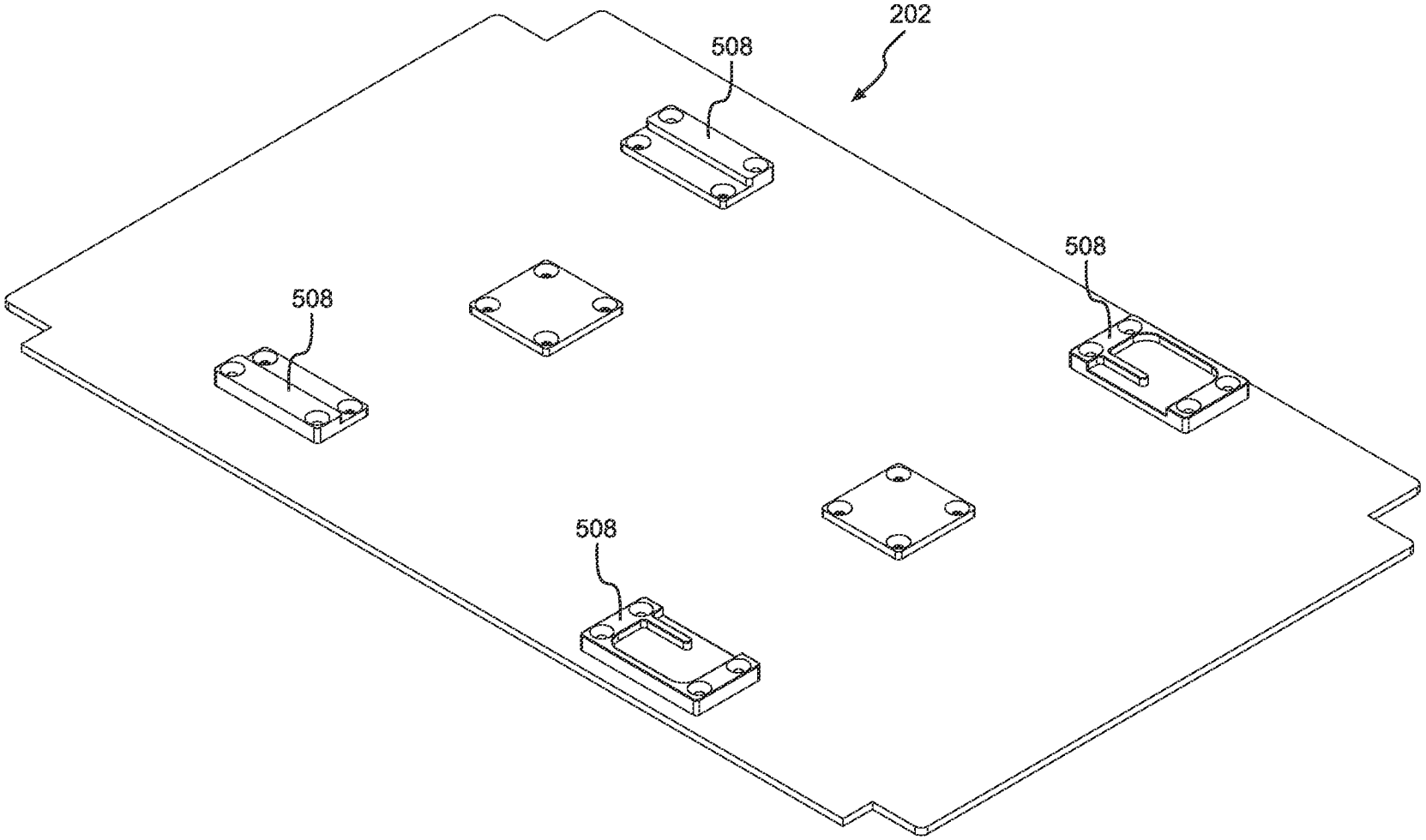
FIG. 6 illustrates another perspective view of the cone loading/unloading station shown in FIG. 5 in accordance with aspects of the current disclosure.

FIG. 5 illustrates a perspective view of the cone loading/unloading station 202. FIG. 6 illustrates another perspective view of the cone loading/unloading station 202. The cone loading/unloading station 202 is configured to receive the lower tube assembly 502 and the tray 504 (including the loaded cones) from the tamping station 104. More specifically, during operations, the lower tube assembly 502 and the tray 504 are tamped at the tamping station 104 as described above and an operator transports the lower tube assembly 502 and the tray 504 from the tamping station 104 to the cone loading/unloading station 202. The lower tube assembly 502 and/or the tray 504 include at least one locking tab 506 and the cone loading/unloading station 202 includes at least one locking guide 508 configured to receive and lock in place the at least one locking tab 506. In the illustrated embodiment, the lower tube assembly 502 and/or the tray 504 include a plurality of locking tabs 506 and the cone loading/unloading station 202 includes a plurality of locking guides 508 configured to receive and lock in place the locking tabs 506. Each locking guides 508 has a shape that is complementary to a shape of one of the locking tabs 506 such that the locking guides 508 receive the locking tabs 506 and secure the lower tube assembly 502 and the tray 504 in a stable position. In some embodiments, the locking tabs 506 may all have the same shape and the locking guides 508 may also all have the same shape. In other embodiments, the locking tabs 506 may all have different shapes and the locking guides 508 may also all have different shapes such that each locking guide 508 is only configured to receive a specified locking tab 506.

Together the locking tabs 506 and the locking guides 508 define a locking mechanism that maintains the lower tube assembly 502 and the tray 504 (including the loaded cones) in a fixed location and orientation during operations. For example, in some embodiments, the locking guides 508 may each include custom machined guides that correspond to a custom shape of the locking tabs 506 to attach the locking tabs 506 to the locking guides 508 and to maintain the lower tube assembly 502 and the tray 504 (including the loaded cones) in a fixed location and orientation during operations. The custom machined guides may be configured to fit to the bottom tray like puzzle pieces fitting together such that, when the tray 504 is loaded into the cone loading/unloading station 202, the locking guides 508 prevent the tray 504 from shifting, effectively locking the lower tube assembly 502 and the tray 504 in place. In alternative embodiments, the locking mechanism may include any locking mechanism that enables the cone loading/unloading station 202 to operate as described herein.

Figure 7:
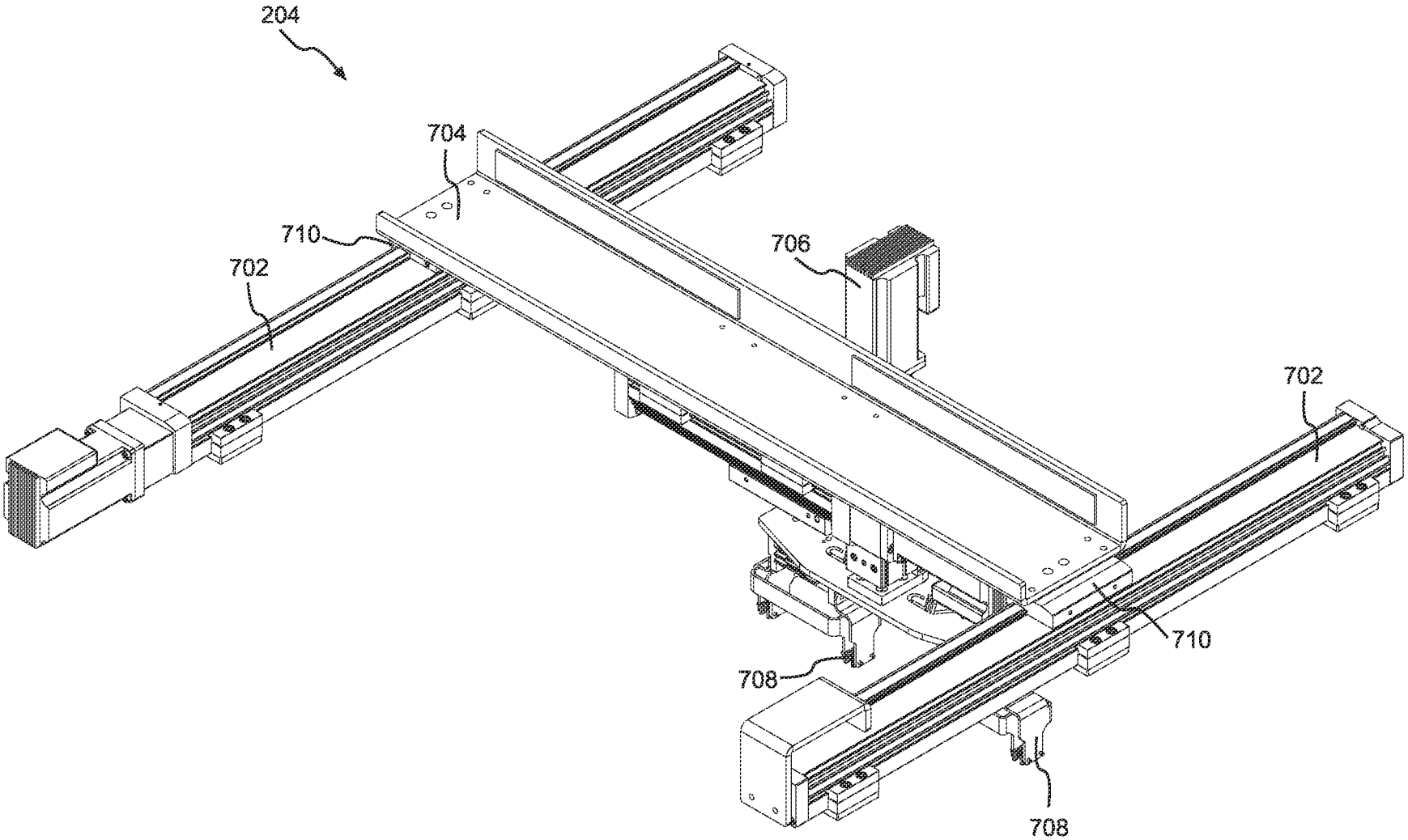
FIG. 7 illustrates a perspective view of the pick and place gripper shown in FIG. 2 in accordance with aspects of the current disclosure.
Figure 8:
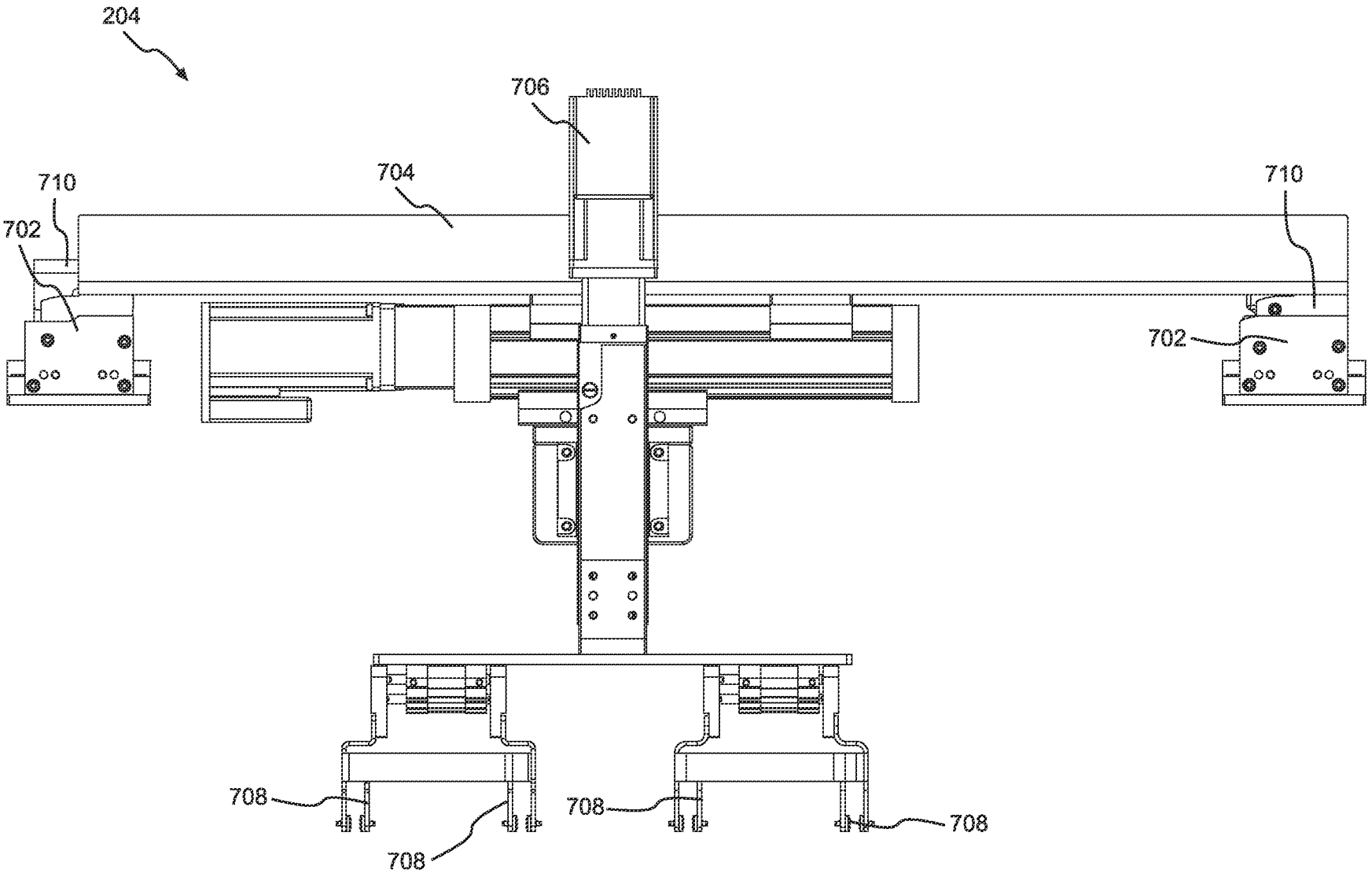
FIG. 8 illustrates a front view of the pick and place gripper shown in FIG. 2 in accordance with aspects of the current disclosure.

FIG. 7 illustrates a perspective view of the pick and place gripper 204. FIG. 8 illustrates a front view of the pick and place gripper 204. The pick and place gripper 204 is positioned above the cone loading/unloading station 202 and the holder assembly 206. The pick and place gripper 204 includes two rails 702, a girder 704, a Z-axis orienter 706, at least one gripper 708, an X-Y axis orienter 710, and two end trucks 712. In the illustrated embodiment, the pick and place gripper 204 includes four grippers 708. In alternative embodiments, the pick and place gripper 204 may include any number of grippers 708 including, without limitation, one, two, three, five, and/or more than five grippers 708.

The two end trucks 612 are attached to the girder 704 and the two rails 702 such that the two end trucks 712 move the girder 704, the Z-axis orienter 706, X-Y axis orienter 710, and the at least one gripper 708 along the rails 702. Specifically, the two end trucks 712 each include high precision smart motors that are specifically programmed with custom software comprising instructions executable on at least one processor to move with 1/10,000 of an inch precision. Additionally, the Z-axis orienter 706 and the X-Y axis orienter 710 each includes a linear actuator driven by high precision smart motors that are also specifically programmed with custom software comprising instructions executable on at least one processor to move with 1/10,000 of an inch precision. For example, the Z-axis orienter 706 and the X-Y axis orienter 710 may each include at least one 250 mm stroke motor or at least one 450 mm stroke motor. The two end trucks 712, the Z-axis orienter 706, and the X-Y axis orienter 710 work with each other to move to the cones as described herein.

The grippers 708 are attached to the Z-axis orienter 706 and the X-Y axis orienter 710, and the two end trucks 712, the X-Y axis orienter 710, and the Z-axis orienter 706 position the grippers 708 above the cone loading/unloading station 202 to enable the grippers 708 to grab one cone each. In the illustrated embodiment, the four grippers 708 grab four cones. The two end trucks 712, the X-Y axis orienter 710, and the Z-axis orienter 706 move the cones to the holder assembly 206 and the grippers 708 place the cones in the holder assembly 206. More specifically, the grippers 708 include rubber pads to ensure a tight hold on the cone. Each gripper 708 is evenly spaced to align with cavities of the lower tube assembly 502 and the cones within the cavities of the lower tube assembly 502. The grippers 708 use the rubber pads to pinch and hold the cones as they are moved from the cone loading/unloading station 202 to the holder assembly 206.

Figure 9:
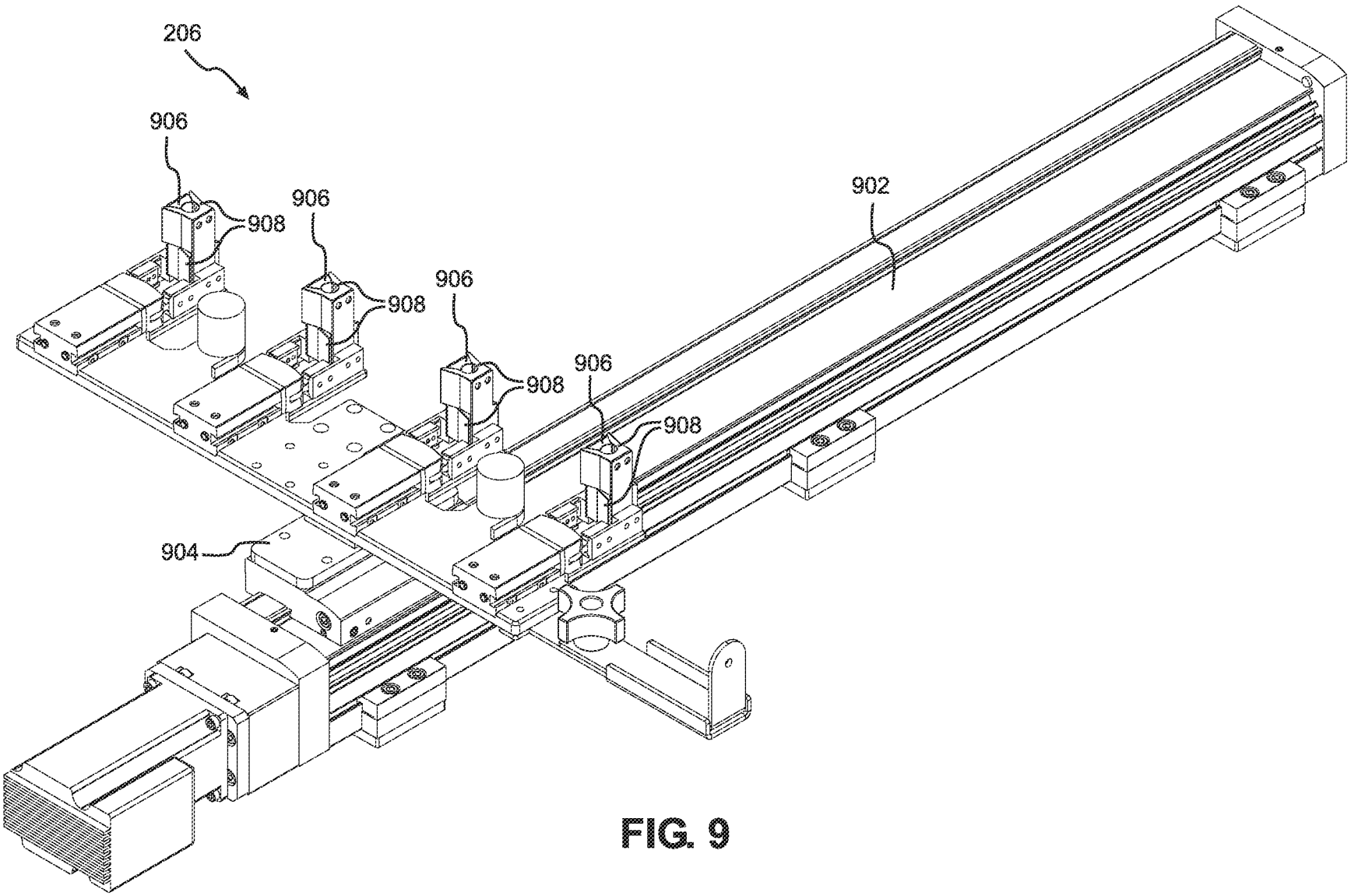
FIG. 9 illustrates a perspective view of the holder assembly shown in FIG. 2 in accordance with aspects of the current disclosure.
Figure 10:
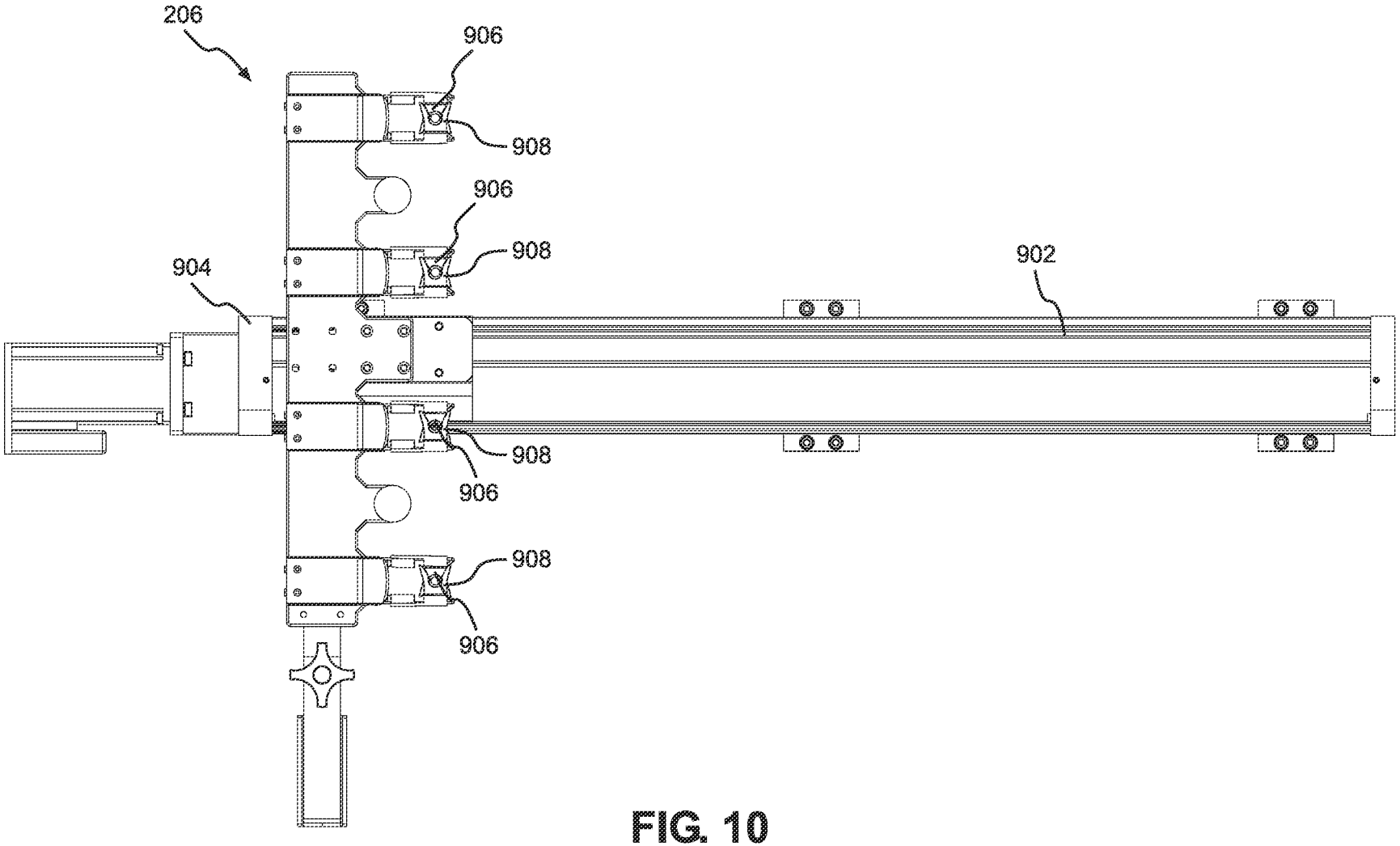
FIG. 10 illustrates a top view of the holder assembly shown in FIG. 2 in accordance with aspects of the current disclosure.

FIG. 9 illustrates a perspective view of the holder assembly 206. FIG. 10 illustrates a top view of the holder assembly 206. The holder assembly 206 is positioned below the pick and place gripper 204, the closing station 208, the cut station 210, and the tamp station 214 and above the vacuum collector 212 and the collection station 216. The holder assembly 206 includes a rail 902, a truck 904, and at least one holder 906. In the illustrated embodiment, the holder assembly 206 includes four holders 906. In alternative embodiments, the holder assembly 206 may include any number of holders 906 including, without limitation, one, two, three, five, and/or more than five holders 906.

The truck 904 is attached to the rail 902 and the holders 906 such that the truck 904 moves the holders 906 along the rail 902. Specifically, the truck 904 includes high precision smart motors that are specifically programmed with custom software comprising instructions executable on at least one processor to move with 1/10,000 of an inch precision. The truck 904 moves the holders 906 along the rail 902 such that the holders 906 (including cones) are progressively positioned below the closing station 208, the cut station 210, and the tamp station 214 and above the vacuum collector 212 and the collection station 216. The holders 906 each include custom machined fingers 908 that are shaped to correspond to the conical angle of the cone. The custom machined fingers 908 each have a shape that corresponds to the shape of another custom machined fingers 908 such that the custom machined fingers 908 fit together like a puzzle to ensure a tight hold on all sides of the cone. The holders 906 are attached to a linear actuator 902 and 804 that moves the cones to each of the stations. The linear actuator is driven by a smart motor that ensures the cones are perfectly aligned with each station.

Figure 11:
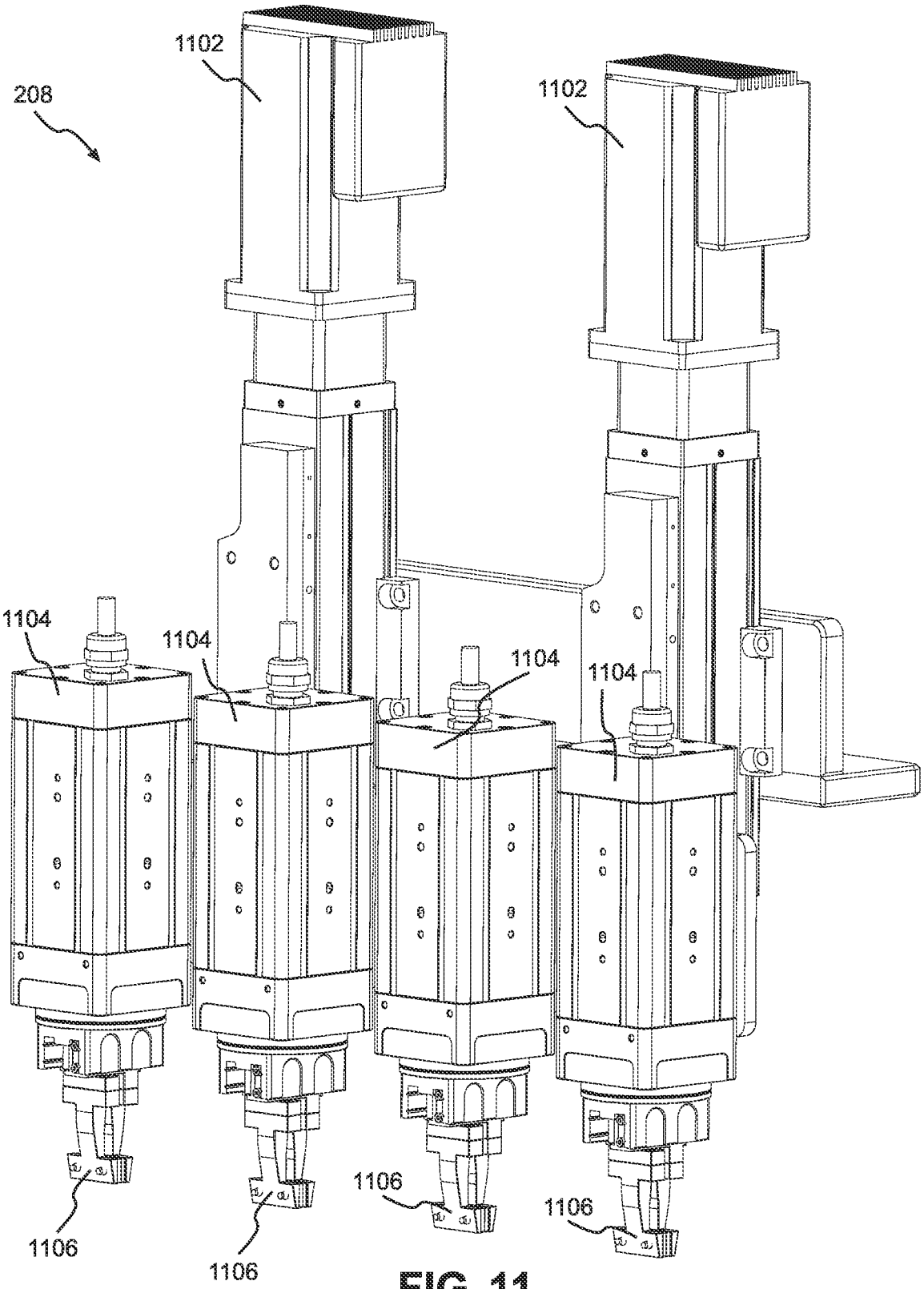
FIG. 11 illustrates a perspective view of the closing station shown in FIG. 2 in accordance with aspects of the current disclosure.
Figure 12:
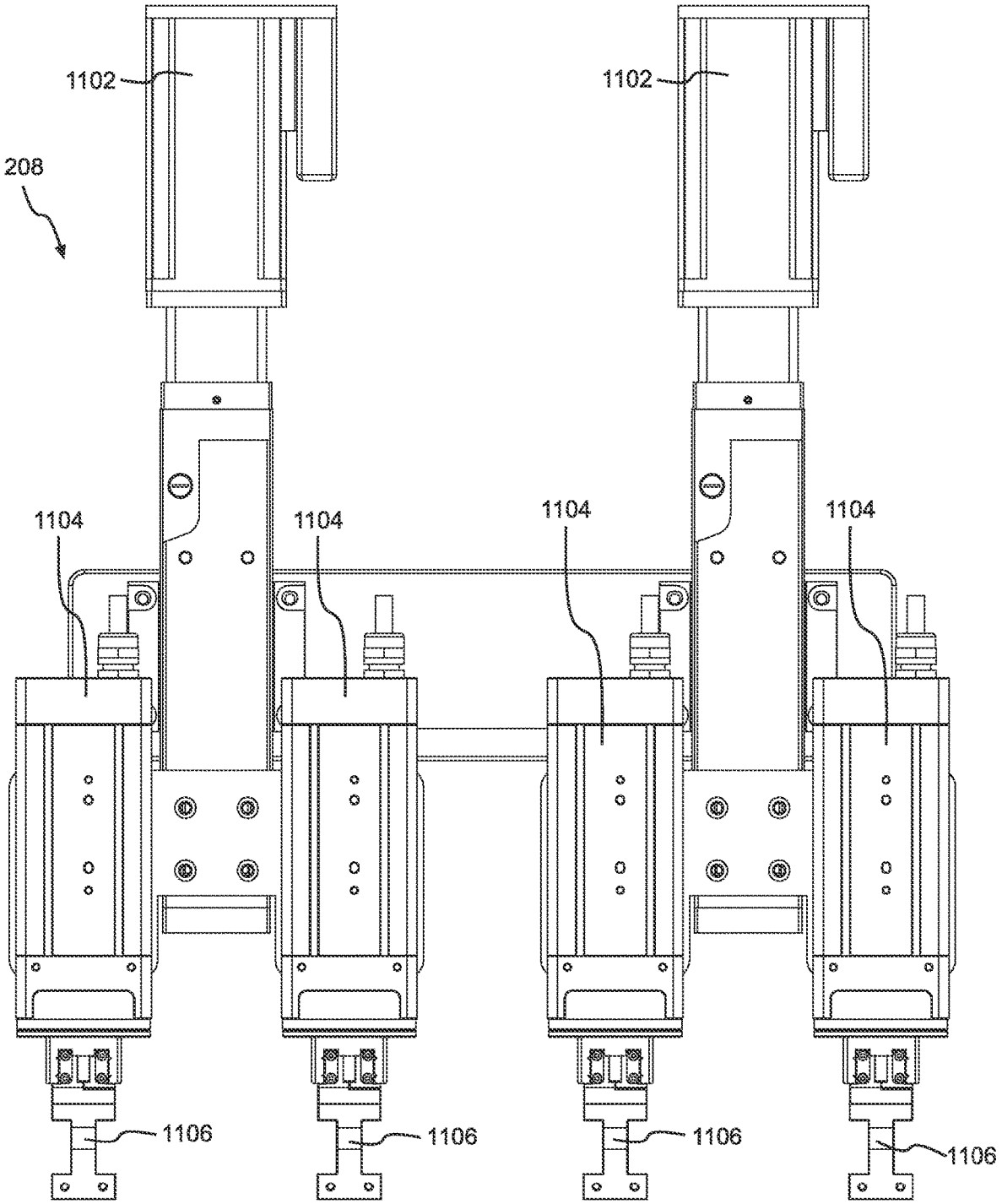
FIG. 12 illustrates a front view of the closing station shown in FIG. 2 in accordance with aspects of the current disclosure.

FIG. 11 illustrates a perspective view of the closing station 208. FIG. 12 illustrates a front view of the closing station 208. In the embodiment illustrated in FIGS. 11 and 12, the closing station 208 includes a twisting station. The closing station 208 is positioned above the holder assembly 206 and the holder assembly 206 moves the cones below the closing station 208. In the illustrated embodiment, the closing station 208 includes at least one Z-axis orienter 1102, at least one closing motor 1104, and at least one gripper 1106. In the illustrated embodiment, the closing station 208 includes two Z-axis orienters 1102, four closing motors 1104, and four grippers 1106. In alternative embodiments, the closing station 208 may include any number of Z-axis orienters 1102, closing motors 1104, and grippers 1106 including, without limitation, one, two, three, five, and/or more than five Z-axis orienters 1102, closing motors 1104, and grippers 1106.

The Z-axis orienters 1102 are attached to the closing motors 1104 and the grippers 1106 such that the Z-axis orienters 1102 move the closing motors 1104 and the grippers 1106 to the cones positioned in the holders 906. Specifically, the Z-axis orienters 1102 each include a linear actuator driven by high precision smart motors that are specifically programmed with custom software comprising instructions executable on at least one processor to move with 1/10,000 of an inch precision. For example, the Z-axis orienters 1102 may each include at least one 250 mm stroke motor or at least one 450 mm stroke motor.

The grippers 1106 include rubber pads to ensure a tight hold on the cones. that pinch and hold the tops or ends of the cones. The grippers 1106 are attached to the closing motors 1104, and, in the illustrated embodiment, the closing motors 1104 twist the grippers 1106 to twist the tops of the cones within the holders 906. Additionally, the Z-axis orienters 1102 move the closing motors 1104 and the grippers 1106 downward towards the holders 906 as the closing motors 1104 twists the tops of the cones. Twisting the tops of the cones shortens the cones and moving the closing motors 1104 and the grippers 1106 downward towards the holders 906 as the closing motors 1104 twists the tops of the cones prevents the grippers 1106 from pulling the cones out of the holders 906.

Figure 13:
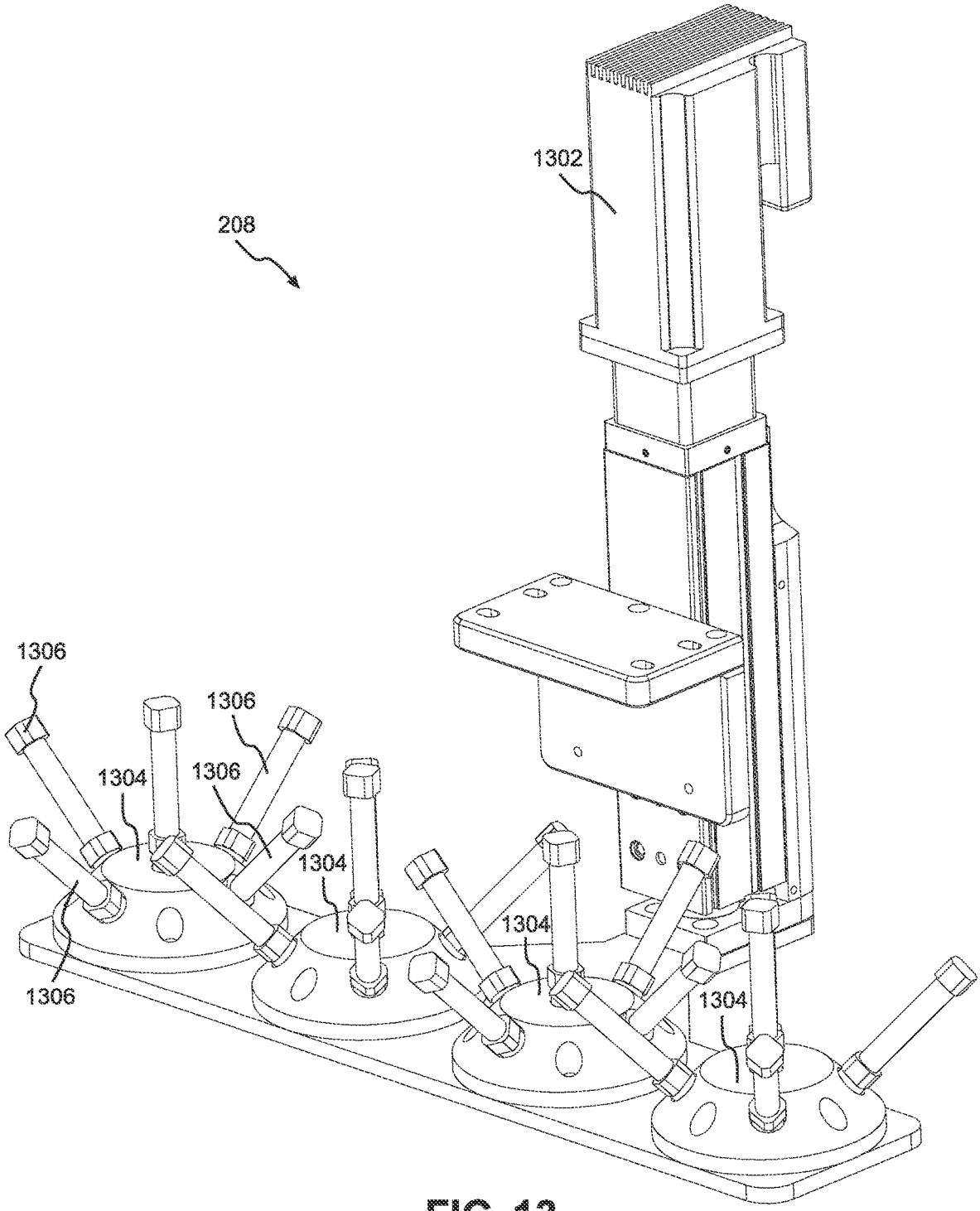
FIG. 13 illustrates a perspective view of an alternative embodiment of the closing station shown in FIG. 2 in accordance with aspects of the current disclosure.

FIG. 13 illustrates a perspective view of an alternative embodiment of the closing or folding station 208. In the embodiment illustrated in FIG. 13, the closing station 208 includes a folding station. The closing station 208 is positioned above the holder assembly 206 and the holder assembly 206 moves the cones below the closing station 208. In the illustrated embodiment, the closing station 208 includes at least one Z-axis orienter 1302, at least one pneumatic closer 1304, and at least one pneumatic piston 1306. In the illustrated embodiment, the closing station 208 includes one Z-axis orienter 1302, four pneumatic closers 1304, and twenty pneumatic pistons 1306 (five on each pneumatic closer 1304). In alternative embodiments, the closing station 208 may include any number of Z-axis orienters 1302, closing motors 1304, and pneumatic pistons 1306 that enable the closing station 208 to operate as described herein.

The Z-axis orienter 1302 is attached to the pneumatic closers 1304 and the pneumatic pistons 1306 such that the Z-axis orienter 1302 moves the pneumatic closers 1304 and the pneumatic pistons 1306 to the cones positioned in the holders 906. Specifically, the Z-axis orienter 1302 each includes a linear actuator driven by high precision smart motors that is specifically programmed with custom software comprising instructions executable on at least one processor to move with 1/10,000 of an inch precision. For example, the Z-axis orienter 1302 may include at least one 250 mm stroke motor or at least one 450 mm stroke motor.

The pneumatic pistons 1306 each include a custom machined tip that push, press, and/or fold the tops or ends of the cones to ensure a clean fold. The five pneumatic pistons 1306 are each mounted to a custom pneumatic closer 1304 designed to ensure the pneumatic pistons 1306 are folding the material at the top of the cone at the correct angle. The four pneumatic closer 1304 are evenly spaced to ensure alignment with the cones below. Specifically, each pneumatic piston 1306 of each of the pneumatic closers 1304 is positioned at an angle relative to the top of the cones such that each piston of the pneumatic pistons 1306 folds the top of the cone in a different direction. Once all five pneumatic pistons 1306 have been actuated, the top of the cone is folded such that the smokeable product is secured within the cone. In this configuration, the tamp station 214 is removed and replaced with the folding station 208 and the cones are indexed differently in this configuration. The four cones are moved from the cone loading/unloading station 202 to the holder assembly 206 by the pick and place gripper 204. Once the cones are in the holder assembly 206, they are moved to the cut station 210 to trim any excess paper as described herein. Then they are moved to the folding station 208, where they are folded closed using the 5-cylinder folding mechanism described herein.

Figure 14:
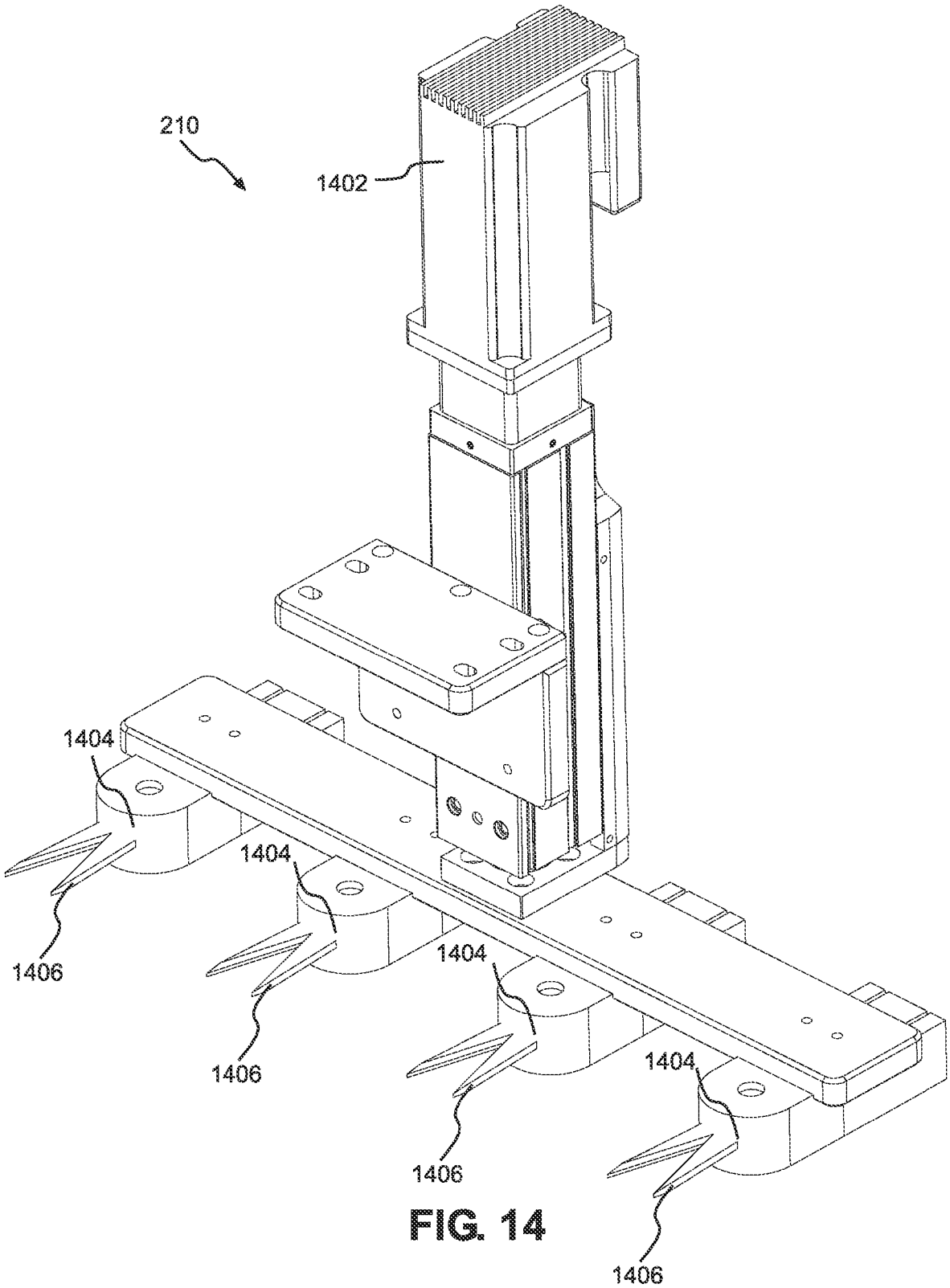
FIG. 14 illustrates a perspective view of the cut station shown in FIG. 2 in accordance with aspects of the current disclosure.
Figure 15:
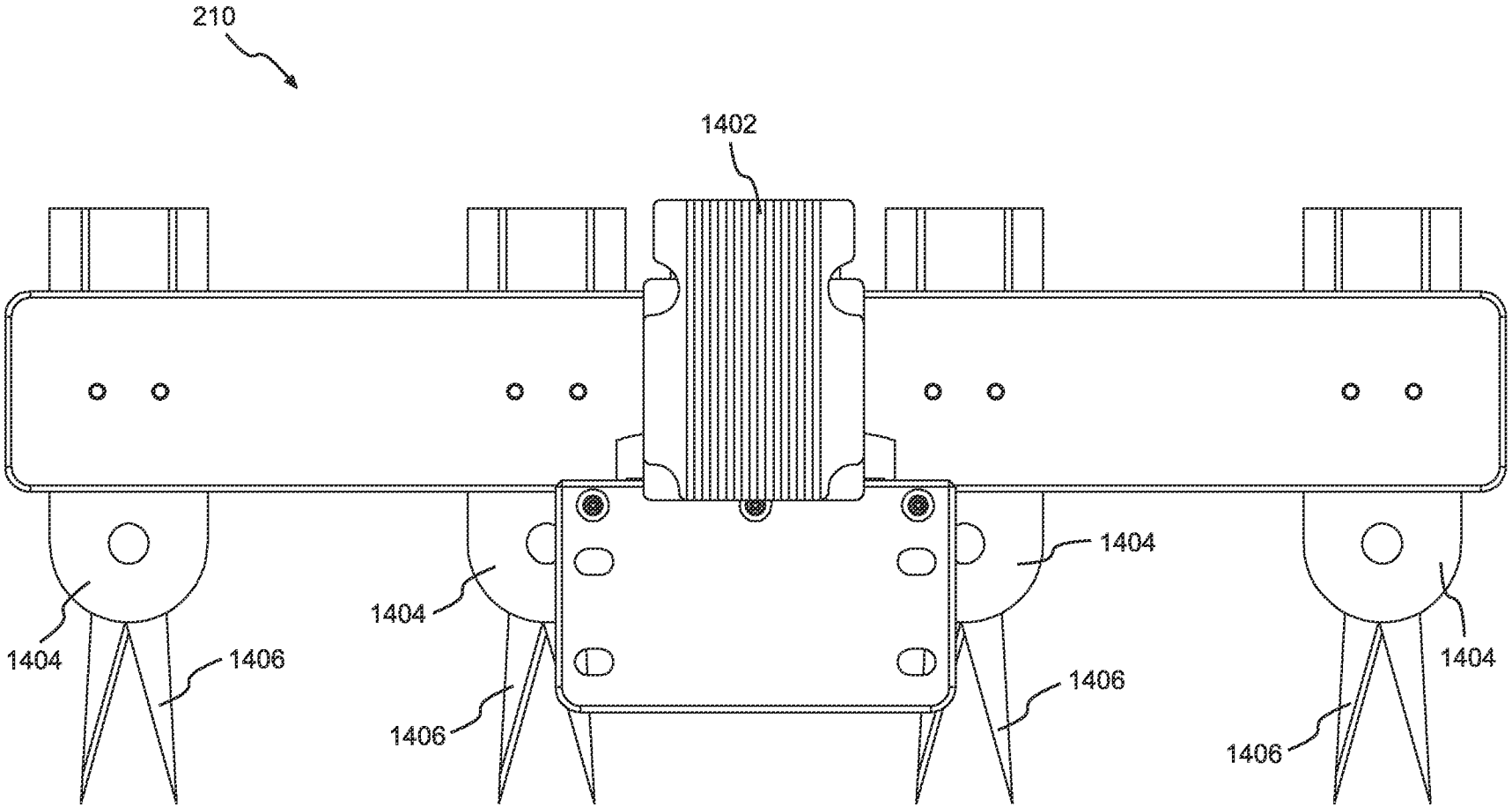
FIG. 15 illustrates a front view of the cut station shown in FIG. 2 in accordance with aspects of the current disclosure.

FIG. 14 illustrates a perspective view of the cut station 210. FIG. 15 illustrates a front view of the cut station 210. The cut station 210 is positioned above the holder assembly 206 and the holder assembly 206 moves the cones below the cut station 210. In the illustrated embodiment, the cut station 210 includes at least one Z-axis orienter 1402, at least one actuator 1404, and at least one cutter 1406. In the illustrated embodiment, the cut station 210 includes one Z-axis orienter 1402, four actuators 1404, and four cutters 1406. In alternative embodiments, the cut station 210 may include any number of Z-axis orienters 1402, actuators 1404, and cutters 1406 that enable the cut station 210 to operate as described herein. In the illustrated embodiment, the cutters 1406 include scissors. In alternative embodiments, the cutters 1406 may include any type of cutting device that enables the cut station 210 to operate as described herein.

The Z-axis orienter 1402 is attached to the actuators 1404 and the cutters 1406 such that the Z-axis orienter 1402 moves the actuators 1404 and the cutters 1406 to the cones positioned in the holders 906. Specifically, the Z-axis orienter 1402 includes a linear actuator driven by high precision smart motors that is specifically programmed with custom software comprising instructions executable on at least one processor to move with 1/10,000 of an inch precision. For example, the Z-axis orienter 1402 may include at least one 250 mm stroke motor or at least one 450 mm stroke motor. The actuators 1404 actuate the scissors such that the scissors cut off excess material or paper on the top of the cones.

Figure 16:
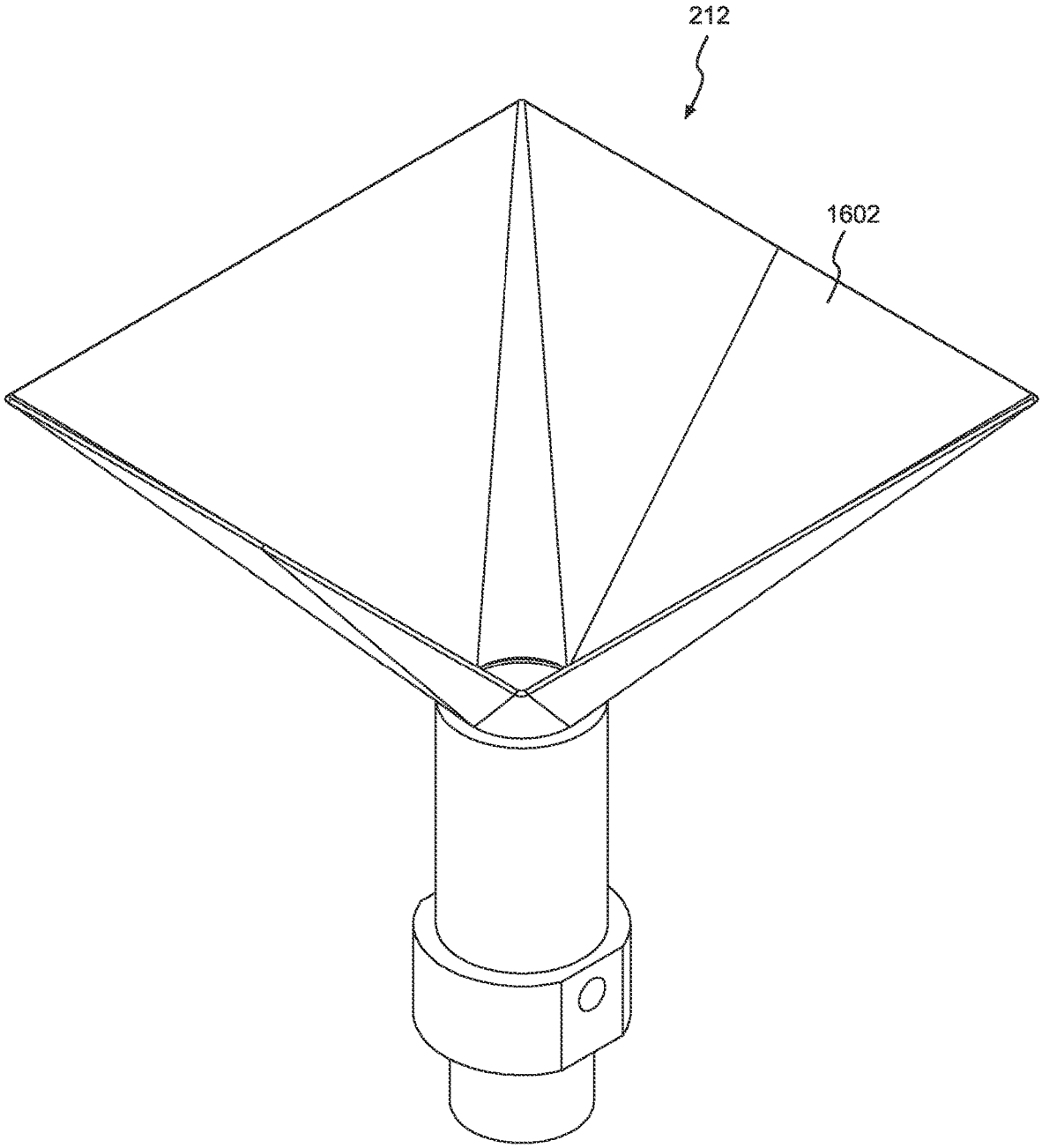
FIG. 16 illustrates a perspective view of a portion of the vacuum collector shown in FIG. 2 in accordance with aspects of the current disclosure.

FIG. 16 illustrates a perspective view of a portion of the vacuum collector 212. The vacuum collector 212 includes a funnel 1602 and a vacuum system (not shown) operatively connected to the funnel 1602. The funnel 1602 is positioned below the holder assembly 206 and the cut station 210 such that, when the tops of the cones are cut off by the cut station 210, the tops fall toward the funnel 1602. The vacuum system generates a suction that pulls the tops toward the funnel 1602 and into the vacuum system to keep the closing machine 200 free of tops.

Figure 17:
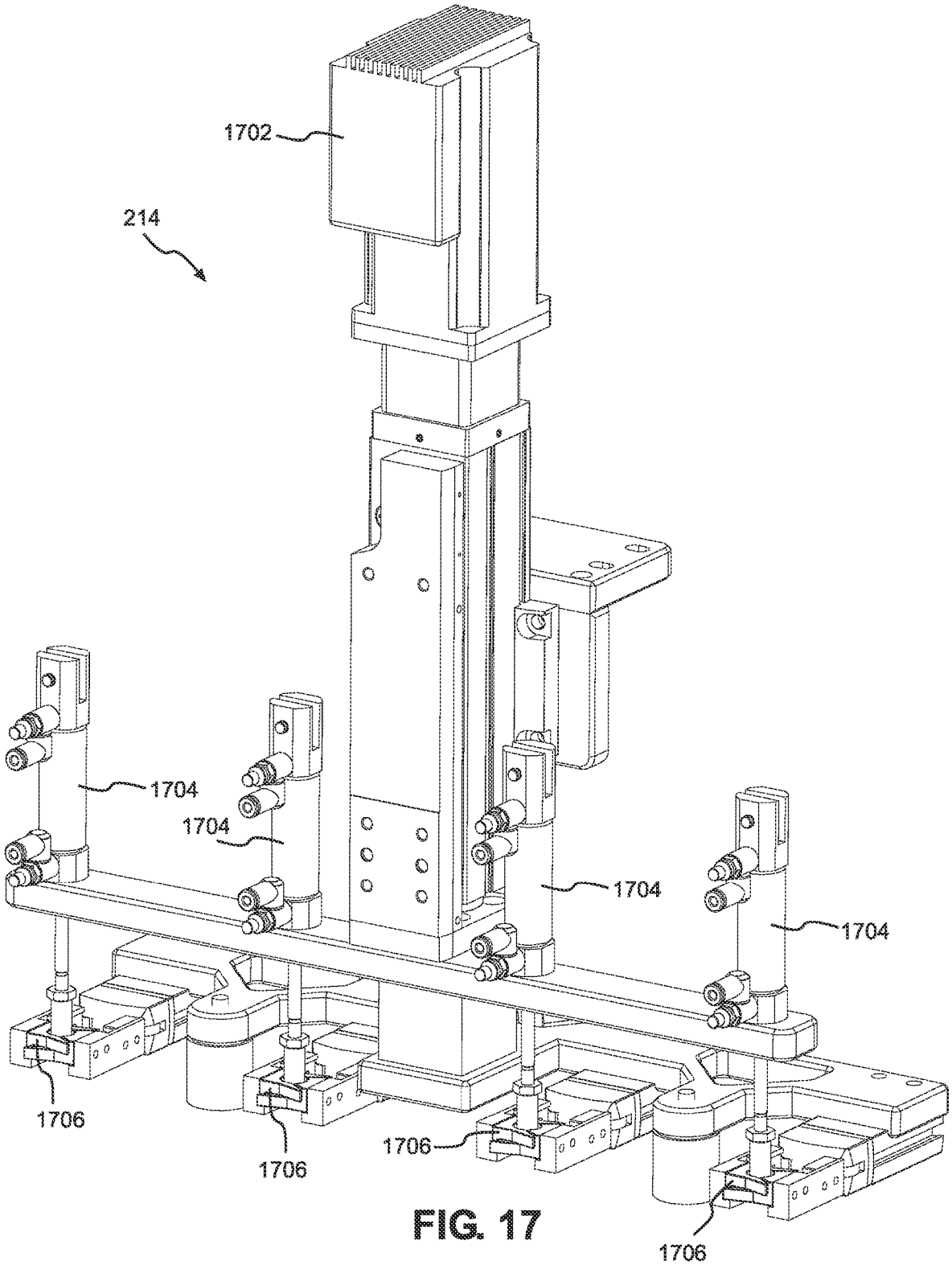
FIG. 17 illustrates a perspective view of the tamp station shown in FIG. 2 in accordance with aspects of the current disclosure.

FIG. 17 illustrates a perspective view of the tamp station 214. The tamp station 214 is positioned above the holder assembly 206 and the holder assembly 206 moves the cones below the tamp station 214. In the illustrated embodiment, the tamp station 214 includes at least one Z-axis orienter 1702, at least one actuator 1704, and at least one gripper 1706. In the illustrated embodiment, the tamp station 214 includes one Z-axis orienter 1702, four actuators 1704, and four grippers 1706. In alternative embodiments, the tamp station 214 may include any number of Z-axis orienters 1702, actuators 1704, and grippers 1706 that enable the tamp station 214 to operate as described herein.

The Z-axis orienter 1702 is attached to the actuators 1704 and the grippers 1706 such that the Z-axis orienter 1702 moves the actuators 1704 and the grippers 1706 to the cones positioned in the holders 906. Specifically, the Z-axis orienter 1702 includes a linear actuator driven by high precision smart motors that is specifically programmed with custom software comprising instructions executable on at least one processor to move with 1/10,000 of an inch precision. For example, the Z-axis orienter 1702 may include at least one 250 mm stroke motor or at least one 450 mm stroke motor. The grippers 1706 include custom machined fingers 1708 that are shaped to correspond to the shape of the top of the cone. The gripper fingers 1708 each have a shape that corresponds to the shape of another custom machined fingers 1708 such that the custom machined fingers 1708 fit together like a puzzle to ensure a tight hold on all sides of the cone. The grippers 1706 are radial grippers that are attached to the linear actuator 1704 such that a height of the tamp station 214 relative to the holder assembly 206 may be adjusted to accommodate cones of different lengths. Additionally, the radial grippers 1706 are evenly spaced to ensure alignment with the cones below. The grippers 1706 and the custom machined fingers 1708 grip and support the top of the cones. The actuators 1704 each include a custom machined tip 1710 that press the top of the cones to compress or tamp the smokeable product in the cones. The custom machined tips 1710 are shaped to create an indent, or a crown, on the top of the cone. The pneumatic actuators 1704 are attached to a linear actuator 1702 that can be adjusted to the proper height of each cone size. The pneumatic actuators 1704 are evenly spaced to ensure alignment with the cones below.

Figure 18:
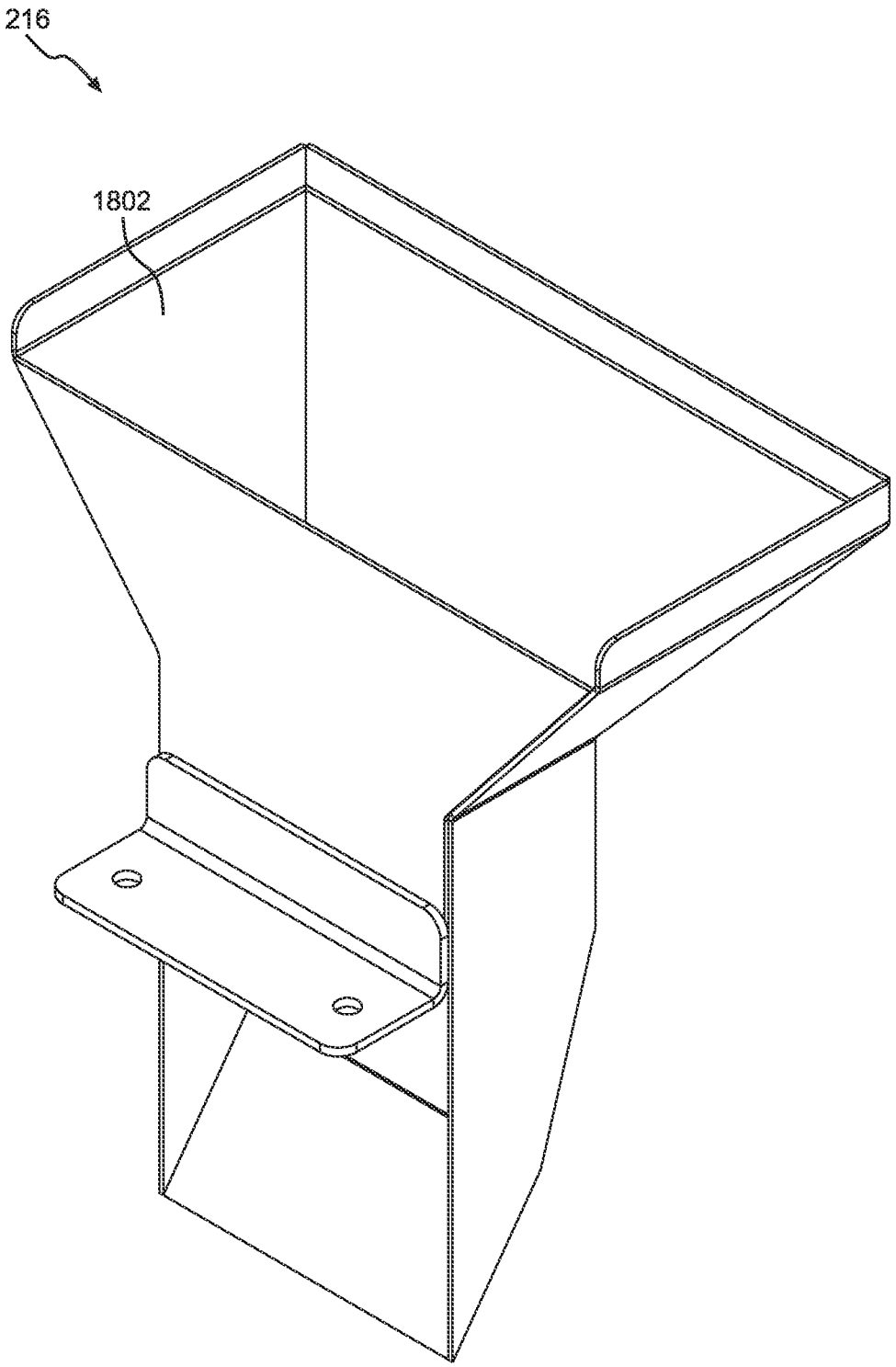
FIG. 18 illustrates a funnel of the collection station shown in FIG. 2 in accordance with aspects of the current disclosure.
Figure 19:
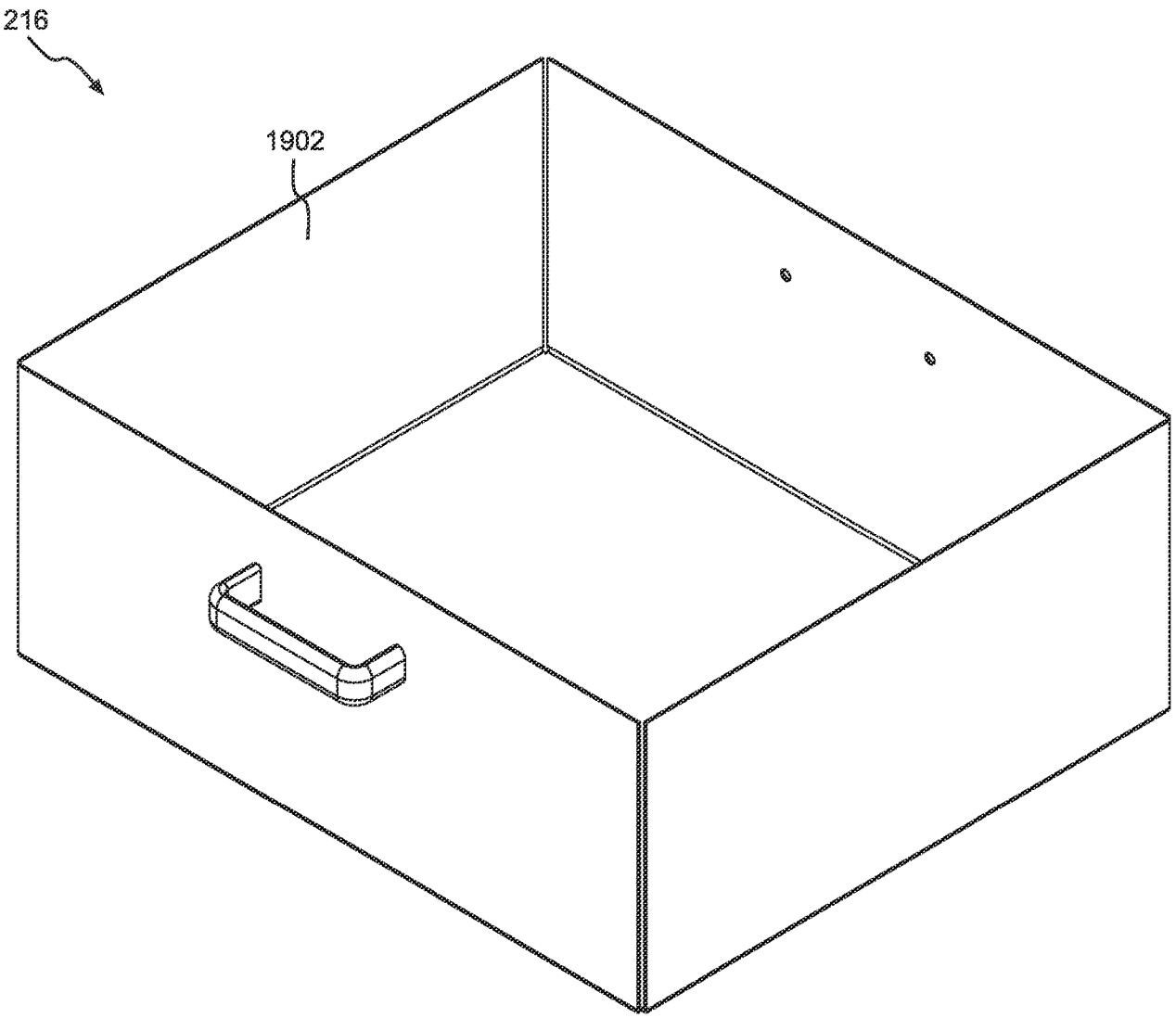
FIG. 19 illustrates a collection bin of the collection station shown in FIG. 2 in accordance with aspects of the current disclosure.
Figure 20:
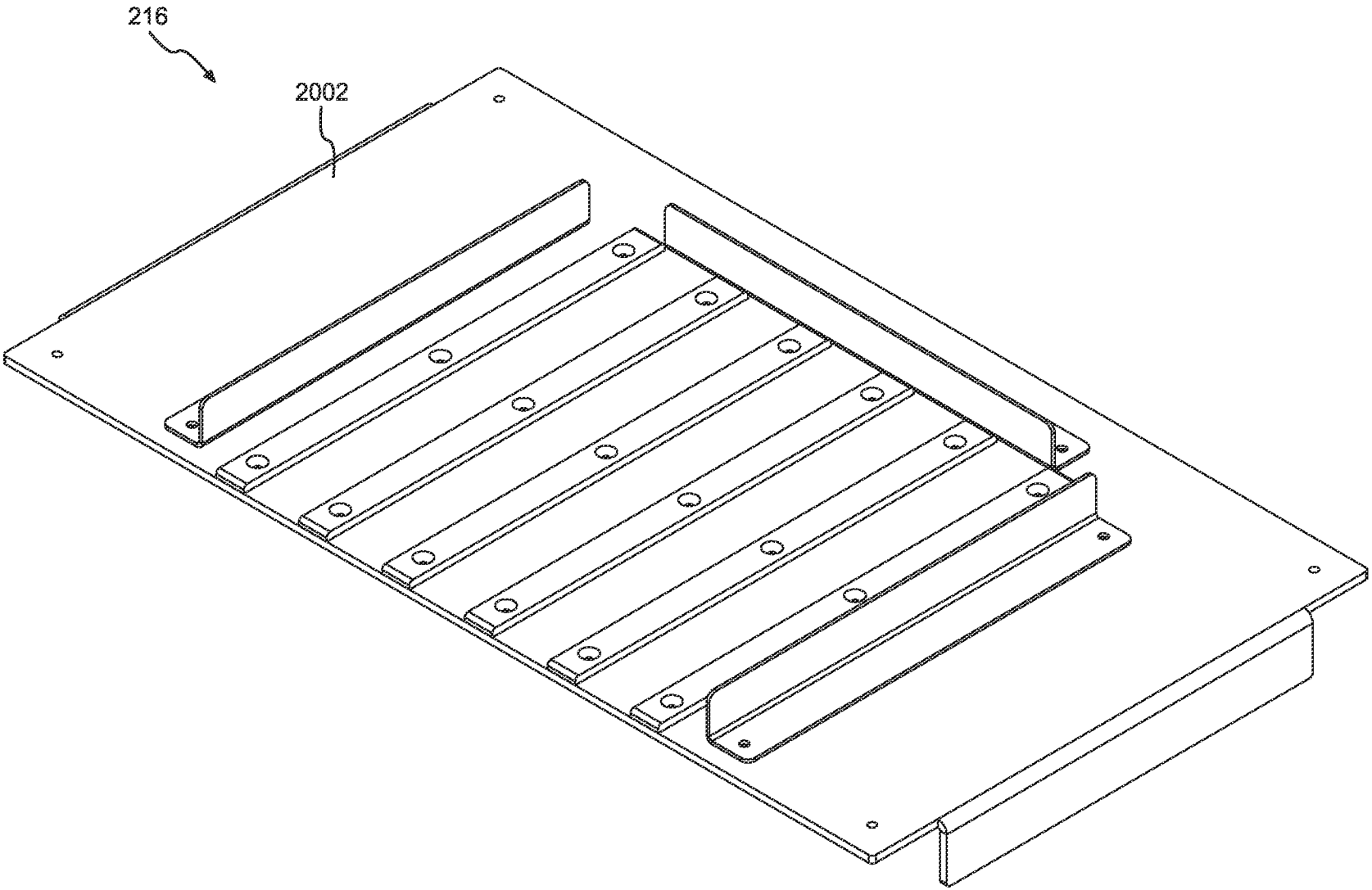
FIG. 20 illustrates a removable platform of the collection station shown in FIG. 2 in accordance with aspects of the current disclosure.

FIGS. 18-20 illustrate portions of the collection station 216. FIG. 18 illustrates a funnel 1802 of the collection station 216. FIG. 19 illustrates a collection bin 1902 of the collection station 216. FIG. 20 illustrates a removable platform 2002 of the collection station 216. The collection station 216 is positioned below the holder assembly 206 and the holder assembly 206 moves the cones above the collection station 216. The holders 906 release the cones and the cones drop into the funnel 1802. The funnel 1802 directs the cones into the collection bin 1902 and, when the collection bin 1902 is full, the collection bin 1902 is pulled out of the collection station 216 using the removeable platform 2002.

Figure 21:
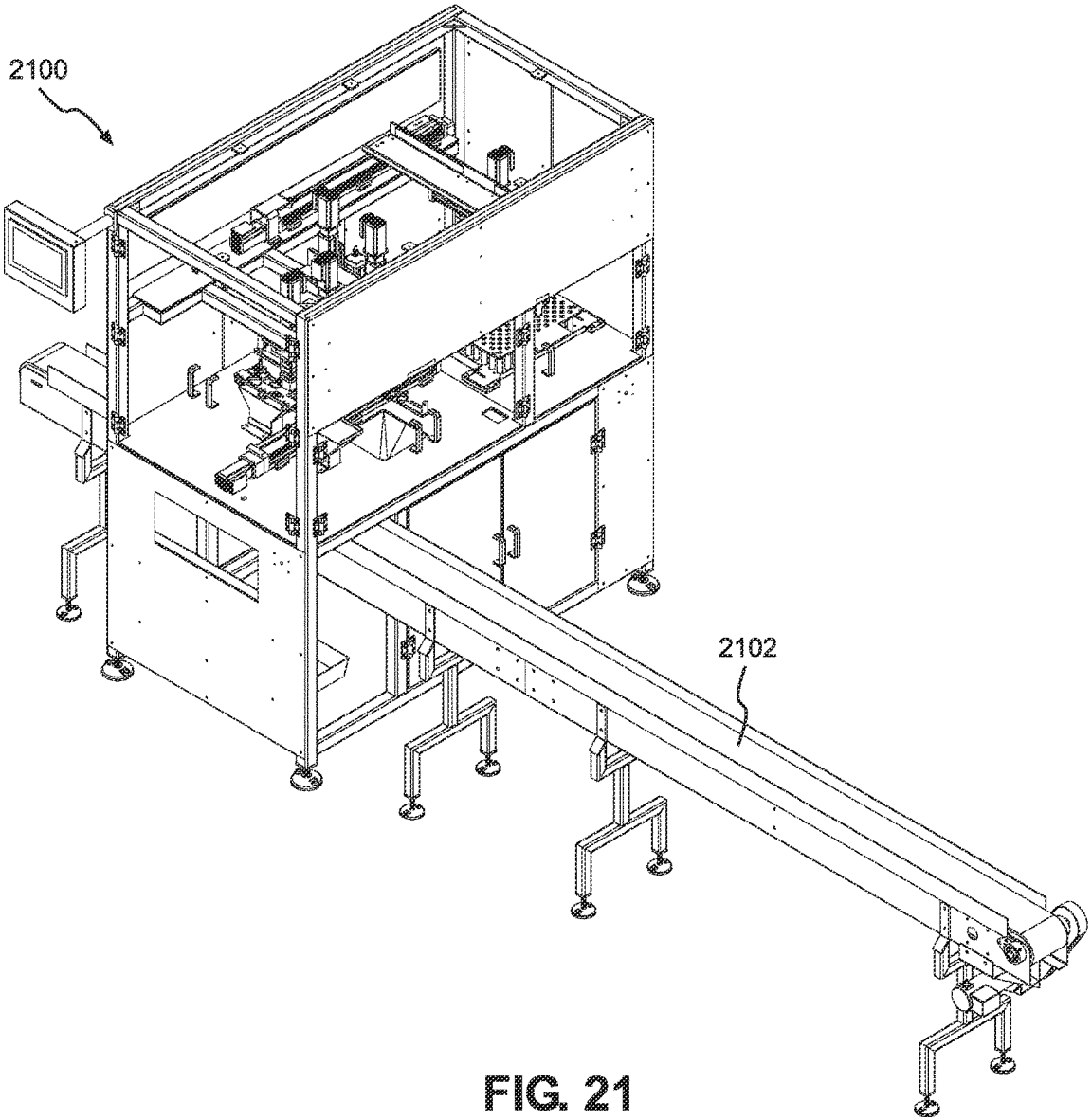
FIG. 21 illustrates a perspective view of an alternative embodiment of a modular pre-roll twisting machine shown in FIG. 2 in accordance with aspects of the current disclosure.

FIG. 21 illustrates a perspective view of an alternative modular pre-roll closing machine 2100 is designed to integrate with equipment downstream in a manufacturing facility. The collection bin 1902 and the removeable platform 2002 are removed and a conveyor 2102 is put in their place to transport the cones to downstream equipment for further processing. Some examples of downstream equipment may include tube filling, carton filling, labelers, cappers, and printers.

Figure 22:
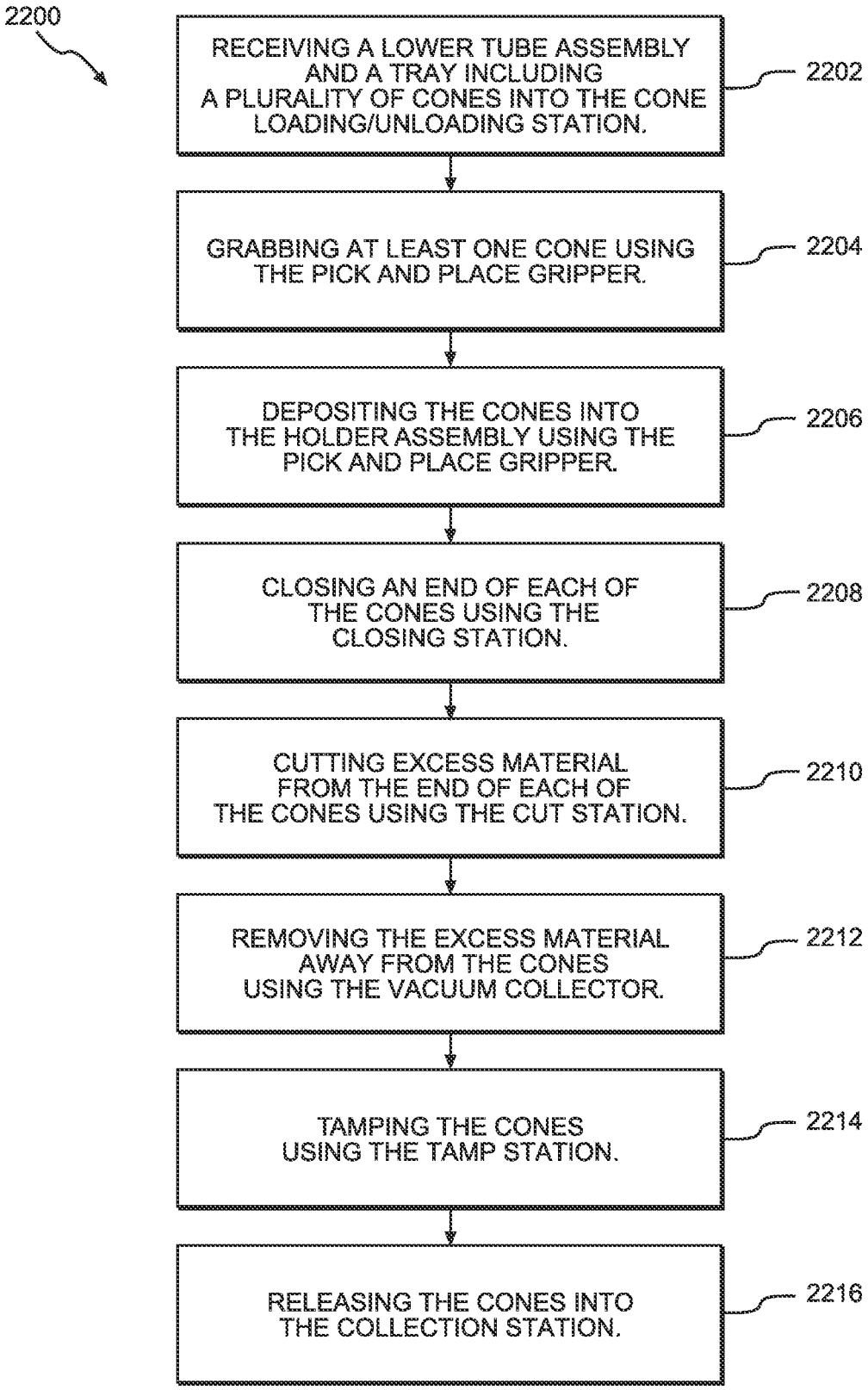
FIG. 22 is a flow chart of a method of closing a plurality of cones containing a smokable product using a closing machine in accordance with aspects of the current disclosure.

FIG. 22 is a flow chart of a method 2200 of closing a plurality of prerolled cones containing a smokable product using a closing machine. The closing machine includes a cone loading/unloading station, a pick and place gripper, a holder assembly, a closing station, a cut station, a vacuum collector, a tamp station, and a collection station. The method 2200 includes receiving 2202 a lower tube assembly and a tray including a plurality of cones into the cone loading/unloading station. The method 2200 also includes grabbing 2204 at least one cone using the pick and place gripper. The method 2200 further includes depositing 2206 the cones into the holder assembly using the pick and place gripper. The method 2200 also includes closing 2208 an end of each of the cones using the closing station. The method 2200 also includes cutting 2210 excess material from the end of each of the cones using the cut station. The method 2200 further includes removing 2212 the excess material away from the cones using the vacuum collector. The method 2200 also includes tamping 2214 the cones using the tamp station. The method 2200 further include releasing 2216 the cones into the collection station.

The modular pre-roll closing machine 200 described herein mimics a hand twisted pre-roll cone. The closing machine 200 tamps, twists, and cuts up to 2,400 pre-rolls per hour and the modular design allows for scalability and compatibility with the accurate net weight based rolling system 100 described herein. The closing machine 200 is driven by PLC controlled servos, which allows for a high precision twist no matter the cone size. The closing machine 200 also uses heavy duty stainless steel & aluminum construction with food grade materials. The closing machine 200 is configured to twist the following standard cone sizes: 109/26, 98/26, and 84/26, and the following premium cone sizes: 70/20 and 98/30. Additionally, the closing machine 200 is configured to twist or fold the following paper types: natural, bleached, hemp, rice, and blunt, and is configured to create spiral or other types of twists. The closing machine 200 may be configured to print logos and/or watermarks on the cones.

The closing machine 200 defines a self-contained system that promotes health and safety, mitigates contaminants, and prevents environmental disturbances. The closing machine 200 also includes 360° access doors with open/close sensors and Lexan shielding. The closing machine 200 further includes top access hatches that allow for non-invasive operational loading. Furthermore, the closing machine 200 includes 316 SS contact surfaces and electro-polishing.

Moreover, the closing machine 200 has precision mechanics including custom grippers, custom XY orienting systems with 0.01 mm movement that mitigates spillage and product waste, electric linear actuator, solid searings, and/or screw drive actuator for use with bottom tier of cone cassettes.

Furthermore, the closing machine 200 is optimized for automation. Specifically, the closing machine 200 has a unique precision production process with a 1/10 (0.1) mm tolerance threshold. The closing machine 200 has a rigorous quality control process that includes evaluating all cones for consistency, seal, and/or length and a final hand quality control measures of the diameter of every cone prior to packing to ensure that every cone meets a predetermined specification and is usable. The closing machine 200 is also certified and insured to meet existing industry standards.

What has been described is a new and improved system for closing prerolls in a manner similar to hand twisted prerolls that are compliant, consistent, repeatable, and scalable, overcoming the limitations and disadvantages inherent in the related art.

As used herein, including in the claims, "or" as used in a list of items (e.g., a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label, or other subsequent reference label.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein but is to be accorded the broadest scope consistent with the principles and novel features disclosed herein.

What is claimed is:

1. A closing machine comprising:

a cone loading/unloading station configured to receive a lower tube assembly and a tray including a plurality of cones from a separate measuring station and/or tamping station, wherein the cone loading/unloading station, the lower tube assembly, and the tray defines a locking mechanism that is configured to maintain the lower tube assembly and the tray in position on the cone loading/unloading station;

at least one pick and place gripper configured to grab at least one cone of the plurality of cones in the lower tube assembly and the tray;

a holder assembly configured to receive the at least one cone from the at least one pick and place gripper and move the at least one cone through the closing machine;

a closing station configured to receive the at least one cone from the holder assembly and configured to close an end of the at least one cone;

a cut station configured to remove excess material from the end of the at least one cone; and a collection station, wherein the holder assembly is further configured to release the at least one cone into the collection station.

2. The closing machine of claim 1, wherein the at least one pick and place gripper comprises at least one gripper configured to grab the at least one cone.

3. The closing machine of claim 1, wherein the closing station comprises a twisting station.

4. The closing machine of claim 3, wherein the twisting station is configured to twist the end of the at least one cone to close the end of the at least one cone.

5. The closing machine of claim 4, wherein the twisting station comprises at least one Z-axis orienter, at least one closing motor, and at least one gripper.

6. The closing machine of claim 5, wherein the at least one gripper is configured to grab the end of the at least one cone.

7. The closing machine of claim 6, wherein the at least one closing motor is configured to twist the at least one gripper after the at least one gripper has grabbed the end of the at least one cone.

8. The closing machine of claim 7, wherein the at least one Z-axis orienter is configured to move the at least one closing motor and the at least one gripper toward the at least one cone while the at least one closing motor twists the at least one gripper.

9. The closing machine of claim 1, wherein the closing station comprises a folding station comprising at least one pneumatic piston configured to press the end of the at least one cone.

10. The closing machine of claim 1, wherein the cut station comprises at least one cutter configured to cut off the excess material from the end of the at least one cone.

11. The closing machine of claim 10, further comprising a vacuum collector configured to collect the excess material from the end of the at least one cone.

12. A method of closing a plurality of prerolled cones containing a smokable product using a closing machine, the closing machine includes a cone loading/unloading station, a pick and place gripper, a holder assembly, a closing station, a cut station, a vacuum collector, a tamp station, and a collection station, the method comprises:

receiving, with the cone loading/unloading station, a lower tube assembly and a tray including a plurality of cones from a separate measuring station and/or tamping station;

grabbing at least one cone using the pick and place gripper;

depositing the at least one cone into the holder assembly using the pick and place gripper;

closing an end of each of the cones using the closing station;

cutting excess material from an end of the cones using the cut station;

tamping the cones using the tamp station; and releasing the cones in the collection station.

13. The method of claim 12, wherein closing an end of each of the cones using the closing station comprises twisting an end of each of the cones using the closing station.

14. The method of claim 13, wherein twisting an end of each of the cones using the closing station comprises:

gripping the end of the cones with a gripper of the closing station; and twisting the gripper of the closing station with a closing motor of the closing station.

15. The method of claim 12, wherein closing an end of each of the cones using the closing station comprises folding an end of each of the cones using the closing station.

16. The method of claim 15, wherein folding an end of each of the cones using the closing station comprises:

pressing the end of the cones with a first pneumatic piston; and pressing the end of the cones with a second pneumatic piston, wherein the first pneumatic piston is oriented at a first angle relative to the end of the cones and the second pneumatic piston is oriented at a second angle relative to the end of the cones different than the first angle.

17. The method of claim 12, further comprising collecting the excess material from the cones using the vacuum collector.

18. A method of manufacturing a plurality of prerolled cones using a system, the system comprising a measuring station, a tamping station, a closing machine, the closing machine includes a cone loading/unloading station, a pick and place gripper, a holder assembly, a closing station, a cut station, a vacuum collector, a tamp station, and a collection station, the method comprises:

measuring a predetermined amount of smokable product using the measuring station;

filling the predetermined amount of smokable product in at least one cone using the measuring station, wherein the at least one cone is positioned in a cavity of a lower tube assembly and a tray during filling;

transporting the lower tube assembly, the tray, and the at least one cone to the tamping station;

tamping the at least one cone using the tamping station;

receiving the lower tube assembly, the tray, and the at least one cone into the closing machine from the tamping station;

locking the lower tube assembly and the tray into the cone loading/unloading station using a locking mechanism;

grabbing the at least one cone using the pick and place gripper;

depositing the at least one cone into the holder assembly using the pick and place gripper;

closing an end of each of the cones using the closing station;

cutting excess material from an end of the at least one cone using the cut station;

tamping the at least one cone using the tamp station; and releasing the at least one cone in the collection station.

19. The method of claim 18, wherein the collection station comprises a conveyor, wherein releasing the at least one cone in the collection station comprises releasing the at least one cone onto the conveyor, and wherein the method further comprises transporting the at least one cone using the conveyor.

* * * * *